US008905117B2

(12) United States Patent
Stevens et al.

(10) Patent No.: US 8,905,117 B2
(45) Date of Patent: Dec. 9, 2014

(54) METHODS OF FORMING AT LEAST A PORTION OF EARTH-BORING TOOLS, AND ARTICLES FORMED BY SUCH METHODS

(75) Inventors: John H. Stevens, Hannover (DE); Jimmy W. Eason, The Woodlands, TX (US)

(73) Assignee: Baker Hughes Incoporated, Houston, TX (US)

( * ) Notice: Subject to any disclaimer, the term of this patent is extended or adjusted under 35 U.S.C. 154(b) by 571 days.

(21) Appl. No.: 13/111,783

(22) Filed: May 19, 2011

(65) Prior Publication Data

US 2011/0287238 A1 Nov. 24, 2011

Related U.S. Application Data

(60) Provisional application No. 61/346,721, filed on May 20, 2010, provisional application No. 61/408,253, filed on Oct. 29, 2010.

(51) Int. Cl.

| | |
|---|---|
| ***B22D 19/06*** | (2006.01) |
| ***C22C 32/00*** | (2006.01) |
| ***B22D 19/14*** | (2006.01) |
| ***C22F 1/10*** | (2006.01) |
| ***C22C 19/07*** | (2006.01) |
| ***C22C 1/10*** | (2006.01) |

(52) U.S. Cl.

CPC ..... *C22F 1/10* (2013.01); *C22C 32/0047* (2013.01); *B22D 19/14* (2013.01); *C22C 19/07* (2013.01); *B22D 19/06* (2013.01); *C22C 32/0052* (2013.01); *C22C 1/1068* (2013.01)

USPC ..... 164/57.1; 164/97; 175/425; 419/18

(58) Field of Classification Search

CPC ..... E21B 10/46

See application file for complete search history.

(56) References Cited

U.S. PATENT DOCUMENTS

| | | | |
|---|---|---|---|
| 2,299,207 | A | 10/1942 | Bevillard |
| 2,819,958 | A | 1/1958 | Abkowitz et al. |
| 2,819,959 | A | 1/1958 | Abkowitz et al. |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |
| 3,800,891 | A | 4/1974 | White |
| 3,942,954 | A | 3/1976 | Frehn |
| 3,987,859 | A | 10/1976 | Lichte |
| 4,017,480 | A | 4/1977 | Baum |
| 4,047,828 | A | 9/1977 | Makely |
| 4,094,709 | A | 6/1978 | Rozmus |
| 4,128,136 | A | 12/1978 | Generoux |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,276,788 | A | 7/1981 | van Nederveen |
| 4,306,139 | A | 12/1981 | Shinozaki et al. |
| 4,334,928 | A | 6/1982 | Hara et al. |
| 4,341,557 | A | 7/1982 | Lizenby |
| 4,351,401 | A | 9/1982 | Fielder |
| 4,389,952 | A | 6/1983 | Dreier et al. |
| 4,398,952 | A | 8/1983 | Drake |
| 4,423,646 | A | 1/1984 | Bernhardt |
| 4,499,048 | A | 2/1985 | Hanejko |
| 4,499,795 | A | 2/1985 | Radtke |
| 4,520,882 | A | 6/1985 | van Nederveen |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,562,990 | A | 1/1986 | Rose |
| 4,579,713 | A | 4/1986 | Lueth |
| 4,596,694 | A | 6/1986 | Rozmus |

(Continued)

FOREIGN PATENT DOCUMENTS

| | | |
|---|---|---|
| AU | 695583 | 2/1998 |
| CA | 2212197 | 10/2000 |

(Continued)

OTHER PUBLICATIONS

Amperweld, Surface Technology, Powders for PTA-Welding, Lasercladding and other Wear Protective Welding Applications, H.C. Starck Empowering High Tech Materials, 4 pages.

International Search Report and Written Opinion for PCT/US2005/014742, completed Jul. 25, 2005.

International Preliminary Report on Patentability for PCT/US2005/014742,dated Nov. 1, 2006.

Sims et al., Superalloys II, Casting Engineering, Aug. 1987, pp. 420-426.

Sikkenga, Cobalt and Cobalt Alloy Castings, Casting, vol. 15, ASM Handbook, ASM International, 2008, pp. 1114-1118.

International Search Report for International Application No. PCT/US2011/037223 mailed Nov. 11, 2011, 6 pages.

International Written Opinion for International Application No. PCT/US2011/037223 mailed Nov. 11, 2011, 5 pages.

(Continued)

*Primary Examiner* — George Wyszomierski
*Assistant Examiner* — Ngoclan T Mai
(74) *Attorney, Agent, or Firm* — TraskBritt

(57) ABSTRACT

Methods of forming at least a portion of an earth-boring tool include providing at least one insert in a mold cavity, providing particulate matter in the mold cavity, melting a metal and a hard material to form a molten composition, and casting the molten composition. Other methods include coating at least one surface of a mold cavity with a coating material having a composition differing from a composition of the mold, melting a metal and a hard material to form a molten composition, and casting the molten composition. Articles comprising at least a portion of an earth-boring tool include at least one insert and a solidified eutectic or near-eutectic composition including a metal phase and a hard material phase. Other articles include a solidified eutectic or near-eutectic composition including a metal phase, a hard material phase and a coating material in contact with the solidified eutectic or near-eutectic composition.

12 Claims, 7 Drawing Sheets

(56) References Cited

U.S. PATENT DOCUMENTS

| | | | |
|---|---|---|---|
| 4,597,456 | A | 7/1986 | Ecer |
| 4,597,730 | A | 7/1986 | Rozmus |
| 4,630,693 | A | 12/1986 | Goodfellow |
| 4,656,002 | A | 4/1987 | Lizenby et al. |
| 4,667,756 | A | 5/1987 | King et al. |
| 4,686,080 | A | 8/1987 | Hara et al. |
| 4,694,919 | A | 9/1987 | Barr |
| 4,743,515 | A | 5/1988 | Fischer et al. |
| 4,744,943 | A | 5/1988 | Timm |
| 4,780,274 | A | 10/1988 | Barr |
| 4,804,049 | A | 2/1989 | Barr |
| 4,809,903 | A | 3/1989 | Eylon et al. |
| 4,838,366 | A | 6/1989 | Jones |
| 4,871,377 | A | 10/1989 | Frushour |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,991,670 | A | 2/1991 | Fuller et al. |
| 5,000,273 | A | 3/1991 | Horton et al. |
| 5,010,945 | A | 4/1991 | Burke |
| 5,030,598 | A | 7/1991 | Hsieh |
| 5,032,352 | A | 7/1991 | Meeks et al. |
| 5,049,450 | A | 9/1991 | Dorfman et al. |
| 5,090,491 | A | 2/1992 | Tibbitts et al. |
| 5,092,412 | A | 3/1992 | Walk |
| 5,161,898 | A | 11/1992 | Drake |
| 5,232,522 | A | 8/1993 | Doktycz et al. |
| 5,281,260 | A | 1/1994 | Kumar et al. |
| 5,286,685 | A | 2/1994 | Schoennahl et al. |
| 5,311,958 | A | 5/1994 | Isbell et al. |
| 5,348,806 | A | 9/1994 | Kojo et al. |
| 5,373,907 | A | 12/1994 | Weaver |
| 5,433,280 | A | 7/1995 | Smith |
| 5,443,337 | A | 8/1995 | Katayama |
| 5,452,771 | A | 9/1995 | Blackman et al. |
| 5,479,997 | A | 1/1996 | Scott et al. |
| 5,482,670 | A | 1/1996 | Hong |
| 5,484,468 | A | 1/1996 | Ostlund et al. |
| 5,506,055 | A | 4/1996 | Dorfman et al. |
| 5,518,077 | A | 5/1996 | Blackman et al. |
| 5,525,134 | A | 6/1996 | Mehrotra et al. |
| 5,543,235 | A | 8/1996 | Mirchandani et al. |
| 5,544,550 | A | 8/1996 | Smith |
| 5,560,440 | A | 10/1996 | Tibbitts |
| 5,586,612 | A | 12/1996 | Isbell et al. |
| 5,593,474 | A | 1/1997 | Keshavan et al. |
| 5,611,251 | A | 3/1997 | Katayama |
| 5,612,264 | A | 3/1997 | Nilsson et al. |
| 5,641,251 | A | 6/1997 | Leins et al. |
| 5,641,921 | A | 6/1997 | Dennis et al. |
| 5,662,183 | A | 9/1997 | Fang |
| 5,666,864 | A | 9/1997 | Tibbitts |
| 5,677,042 | A | 10/1997 | Massa et al. |
| 5,679,445 | A | 10/1997 | Massa et al. |
| 5,697,046 | A | 12/1997 | Conley |
| 5,697,462 | A | 12/1997 | Grimes et al. |
| 5,732,783 | A | 3/1998 | Truax et al. |
| 5,733,649 | A | 3/1998 | Kelley et al. |
| 5,733,664 | A | 3/1998 | Kelley et al. |
| 5,753,160 | A | 5/1998 | Takeuchi et al. |
| 5,755,298 | A | 5/1998 | Langford, Jr. et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,792,403 | A | 8/1998 | Massa et al. |
| 5,803,152 | A | 9/1998 | Dolman et al. |
| 5,806,934 | A | 9/1998 | Massa et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,866,254 | A | 2/1999 | Peker et al. |
| 5,880,382 | A | 3/1999 | Fang et al. |
| 5,893,204 | A | 4/1999 | Symonds |
| 5,897,830 | A | 4/1999 | Abkowitz et al. |
| 5,899,257 | A | 5/1999 | Alleweireldt et al. |
| 5,957,006 | A | 9/1999 | Smith |
| 5,963,775 | A | 10/1999 | Fang |
| 6,029,544 | A | 2/2000 | Katayama |
| 6,051,171 | A | 4/2000 | Takeuchi et al. |
| 6,063,333 | A | 5/2000 | Dennis |
| 6,068,070 | A | 5/2000 | Scott |
| 6,073,518 | A | 6/2000 | Chow et al. |
| 6,086,980 | A | 7/2000 | Foster et al. |
| 6,089,123 | A | 7/2000 | Chow et al. |
| 6,109,377 | A | 8/2000 | Massa et al. |
| 6,109,677 | A | 8/2000 | Anthony |
| 6,135,218 | A | 10/2000 | Deane et al. |
| 6,148,936 | A | 11/2000 | Evans et al. |
| 6,200,514 | B1 | 3/2001 | Meister |
| 6,209,420 | B1 | 4/2001 | Butcher et al. |
| 6,214,134 | B1 | 4/2001 | Eylon et al. |
| 6,214,287 | B1 | 4/2001 | Waldenstrom |
| 6,220,117 | B1 | 4/2001 | Butcher |
| 6,227,188 | B1 | 5/2001 | Tankala et al. |
| 6,228,139 | B1 | 5/2001 | Oskarsson |
| 6,241,036 | B1 | 6/2001 | Lovato et al. |
| 6,254,658 | B1 | 7/2001 | Taniuchi et al. |
| 6,287,360 | B1 | 9/2001 | Kembaiyan et al. |
| 6,290,438 | B1 | 9/2001 | Papajewski |
| 6,293,986 | B1 | 9/2001 | Rodiger et al. |
| 6,302,224 | B1 | 10/2001 | Sherwood, Jr. |
| 6,353,771 | B1 | 3/2002 | Southland |
| 6,372,346 | B1 | 4/2002 | Toth |
| 6,375,706 | B2 | 4/2002 | Kembaiyan et al. |
| 6,453,899 | B1 | 9/2002 | Tselesin |
| 6,454,025 | B1 | 9/2002 | Runquist et al. |
| 6,454,028 | B1 | 9/2002 | Evans |
| 6,454,030 | B1 | 9/2002 | Findley et al. |
| 6,458,471 | B2 | 10/2002 | Lovato et al. |
| 6,474,425 | B1 | 11/2002 | Truax et al. |
| 6,500,226 | B1 | 12/2002 | Dennis |
| 6,511,265 | B1 | 1/2003 | Mirchandani et al. |
| 6,546,991 | B2 | 4/2003 | Dworog et al. |
| 6,576,182 | B1 | 6/2003 | Ravagni et al. |
| 6,589,640 | B2 | 7/2003 | Griffin et al. |
| 6,599,467 | B1 | 7/2003 | Yamaguchi et al. |
| 6,607,693 | B1 | 8/2003 | Saito et al. |
| 6,651,757 | B2 | 11/2003 | Belnap et al. |
| 6,655,481 | B2 | 12/2003 | Findley et al. |
| 6,655,882 | B2 | 12/2003 | Heinrich et al. |
| 6,685,880 | B2 | 2/2004 | Engstrom et al. |
| 6,742,608 | B2 | 6/2004 | Murdoch |
| 6,742,611 | B1 | 6/2004 | Illerhaus et al. |
| 6,756,009 | B2 | 6/2004 | Sim et al. |
| 6,766,870 | B2 | 7/2004 | Overstreet |
| 6,767,505 | B2 | 7/2004 | Witherspoon et al. |
| 6,782,958 | B2 | 8/2004 | Liang et al. |
| 6,799,648 | B2 | 10/2004 | Brandenberg et al. |
| 6,849,231 | B2 | 2/2005 | Kojima et al. |
| 6,918,942 | B2 | 7/2005 | Hatta et al. |
| 7,044,243 | B2 | 5/2006 | Kembaiyan et al. |
| 7,048,081 | B2 | 5/2006 | Smith et al. |
| 7,250,069 | B2 | 7/2007 | Kembaiyan et al. |
| 7,261,782 | B2 | 8/2007 | Hwang et al. |
| 7,270,679 | B2 | 9/2007 | Istephanous et al. |
| 7,556,668 | B2 | 7/2009 | Eason et al. |
| 7,661,491 | B2 | 2/2010 | Kembaiyan et al. |
| 7,687,156 | B2 | 3/2010 | Fang et al. |
| 7,954,569 | B2 | 6/2011 | Mirchandani et al. |
| 8,020,640 | B2 | 9/2011 | Lockwood et al. |
| 2002/0004105 | A1 | 1/2002 | Kunze et al. |
| 2002/0020564 | A1 | 2/2002 | Fang et al. |
| 2002/0175006 | A1 | 11/2002 | Findley et al. |
| 2003/0010409 | A1 | 1/2003 | Kunze et al. |
| 2003/0041922 | A1 | 3/2003 | Hirose et al. |
| 2003/0219605 | A1 | 11/2003 | Molian et al. |
| 2004/0013558 | A1 | 1/2004 | Kondoh et al. |
| 2004/0060742 | A1 | 4/2004 | Kembaiyan et al. |
| 2004/0149494 | A1 | 8/2004 | Kembaiyan et al. |

(56) References Cited

U.S. PATENT DOCUMENTS

| | | | |
|---|---|---|---|
| 2004/0196638 | A1 | 10/2004 | Lee et al. |
| 2004/0243241 | A1 | 12/2004 | Istephanous et al. |
| 2004/0244540 | A1 | 12/2004 | Oldham et al. |
| 2004/0245022 | A1 | 12/2004 | Izaguirre et al. |
| 2004/0245024 | A1 | 12/2004 | Kembaiyan |
| 2005/0008524 | A1 | 1/2005 | Testani |
| 2005/0072496 | A1 | 4/2005 | Hwang et al. |
| 2005/0084407 | A1 | 4/2005 | Myrick |
| 2005/0117984 | A1 | 6/2005 | Eason et al. |
| 2005/0126334 | A1 | 6/2005 | Mirchandani |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032335 | A1 | 2/2006 | Kembaiyan |
| 2006/0032677 | A1 | 2/2006 | Azar et al. |
| 2006/0043648 | A1 | 3/2006 | Takeuchi et al. |
| 2006/0057017 | A1 | 3/2006 | Woodfield et al. |
| 2006/0131081 | A1 | 6/2006 | Mirchandani et al. |
| 2007/0042217 | A1 | 2/2007 | Fang et al. |
| 2007/0056777 | A1 | 3/2007 | Overstreet |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0151770 | A1 | 7/2007 | Ganz |
| 2007/0193782 | A1 | 8/2007 | Fang et al. |
| 2007/0277651 | A1 | 12/2007 | Calnan et al. |
| 2008/0011519 | A1 | 1/2008 | Smith et al. |
| 2008/0028891 | A1 | 2/2008 | Calnan et al. |
| 2008/0101977 | A1 | 5/2008 | Eason et al. |
| 2008/0163723 | A1 | 7/2008 | Mirchandani et al. |
| 2008/0302576 | A1 | 12/2008 | Mirchandani et al. |
| 2009/0301788 | A1 | 12/2009 | Stevens et al. |
| 2010/0193252 | A1 | 8/2010 | Mirchandani et al. |
| 2011/0284179 | A1 | 11/2011 | Stevens et al. |
| 2011/0287924 | A1 | 11/2011 | Stevens |

FOREIGN PATENT DOCUMENTS

| | | | |
|---|---|---|---|
| CA | 2732518 | A1 | 2/2010 |
| EP | 0264674 | A2 | 4/1988 |
| EP | 0453428 | A1 | 10/1991 |
| EP | 0995876 | A2 | 4/2000 |
| EP | 1244531 | B1 | 10/2002 |
| GB | 945227 | | 12/1963 |
| GB | 2315452 | A | 2/1998 |
| GB | 2384745 | A | 8/2003 |
| GB | 2385350 | A | 8/2003 |
| GB | 2393449 | A | 3/2004 |
| JP | 5064288 | | 8/1993 |
| JP | 10219385 | A | 8/1998 |
| UA | 6742 | | 12/1994 |
| UA | 63469 | | 1/2006 |
| UA | 23749 | U | 11/2007 |
| WO | 03049889 | A2 | 6/2003 |
| WO | 2004053197 | A2 | 6/2004 |
| WO | 2007127899 | A2 | 11/2007 |

OTHER PUBLICATIONS

International Preliminary Report on Patentability for International Application No. PCT/US2011/037223 dated Nov. 20, 2012, 6 pages.

Canadian Office Action for Canadian Application No. 2,799,906 dated Apr. 9, 2013, 4 pages.

Canadian Office Action for Canadian Application No. 2,799,911 dated Apr. 11, 2013, 4 pages.

METHODS OF FORMING AT LEAST A PORTION OF EARTH-BORING TOOLS, AND ARTICLES FORMED BY SUCH METHODS

CROSS-REFERENCE TO RELATED APPLICATIONS

This application claims the benefit of U.S. Provisional Patent Application Ser. No. 61/346,721, filed May 20, 2010 and titled "Methods of Casting Earth-Boring Tools and Components of Such Tools, and Articles Formed by Such Methods," and U.S. Provisional Patent Application Ser. No. 61/408,253, filed Oct. 29, 2010, and titled "Coatings for Castable Cemented Carbide Materials," the disclosures of each of which are incorporated herein in their entirety by this reference.

The subject matter of this application is related to the subject matter of U.S. patent application Ser. No. 10/848,437, which was filed May 18, 2004 and titled "Earth-Boring Bits," and U.S. patent application Ser. No. 11/116,752, which was filed Apr. 28, 2005, now U.S. Pat. No. 7,954,569, issued Jun. 7, 2011, and titled "Earth-Boring Bits," the disclosures of each of which are incorporated herein in their entirety by this reference. The subject matter of this application is also related to the subject matter of U.S. patent application Ser. No. 13/111,666, filed May 19, 2011, now U.S. Pat. No. 8,490,674, issued Jul. 23, 2013 and titled "Methods of Forming at Least a Portion of Earth-Boring Tools," and U.S. patent application Ser. No. 13/111,739, filed May 19, 2011, pending, and titled "Methods of Forming at Least a Portion of Earth-Boring Tools, and Articles Formed by Such Methods," each filed on even date herewith and the entire disclosure of each of which is incorporated herein by reference.

TECHNICAL FIELD

Embodiments of the present disclosure relate to earth-boring tools, such as earth-boring rotary drill bits, to components of such tools, and to methods of manufacturing such earth-boring tools and components thereof.

BACKGROUND

Earth-boring tools are commonly used for forming (e.g., drilling and reaming) boreholes or wells (hereinafter "wellbores") in earth formations. Earth-boring tools include, for example, rotary drill bits, core bits, eccentric bits, bi-center bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end and extends into the wellbore from the surface of the formation. Often various tools and components, including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Rolling-cutter drill bits typically include three roller cones mounted on supporting bit legs that extend from a bit body, which may be formed from, for example, three bit head sections that are welded together to form the bit body. Each bit leg may depend from one bit head section. Each roller cone is configured to spin or rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts formed of hard, wear-resistant material are secured within the receptacles to form the cutting elements of the cones. As the rolling-cutter drill bit is rotated within a wellbore, the roller cones roll and slide across the surface of the formation, which causes the cutting elements to crush and scrape away the underlying formation.

Fixed-cutter drill bits typically include a plurality of cutting elements that are attached to a face of the bit body. The bit body may include a plurality of wings or blades, which define fluid courses between the blades. The cutting elements may be secured to the bit body within pockets foamed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

Impregnated diamond rotary drill bits may be used for drilling hard or abrasive rock formations such as sandstones. Typically, an impregnated diamond drill bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

Wear-resistant materials, such as "hardfacing" materials, may be applied to the formation-engaging surfaces of rotary drill bits to minimize wear of those surfaces of the drill bits caused by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling.

BRIEF SUMMARY

In some embodiments, the invention includes a method of forming at least a portion of an earth-boring tool. The method comprises providing at least one insert in a mold cavity, providing particulate matter comprising a hard material in the mold cavity, melting a metal and the hard material to form a molten composition comprising a eutectic or near-eutectic composition of the metal and the hard material, and casting the molten composition within the mold cavity.

In other embodiments, the invention includes a method of forming a roller cone of an earth-boring rotary drill bit. The method comprises providing at least one insert within a mold cavity, forming a molten composition comprising a eutectic or near-eutectic composition of cobalt and tungsten carbide, casting the molten composition within the mold cavity adjacent at least a portion of the at least one insert, and solidifying the molten composition within the mold.

In other embodiments, a method of forming at least a portion of an earth-boring tool comprises coating at least one surface of a mold cavity within a mold with a coating material having a composition differing from a composition of the mold, melting a metal and a hard material to form a molten composition comprising a eutectic or near-eutectic composition of the metal and the hard material, and casting the molten composition within the mold cavity.

In certain embodiments, the invention includes an article comprising at least a portion of an earth-boring tool. The article includes at least one insert and a solidified eutectic or near-eutectic composition including a metal phase and a hard material phase.

In other embodiments, an article comprising at least a portion of an earth-boring tool includes a solidified eutectic or near-eutectic composition including a metal phase, a hard material phase and a coating material in contact with the solidified eutectic or near-eutectic composition.

BRIEF DESCRIPTION OF THE DRAWINGS

While the specification concludes with claims particularly pointing out and distinctly claiming what are regarded as embodiments of the present invention, various features and advantages of this disclosure may be more readily ascertained from the following description of example embodiments provided with reference to the accompanying drawings, in which:

DETAILED DESCRIPTION

Figure 1:
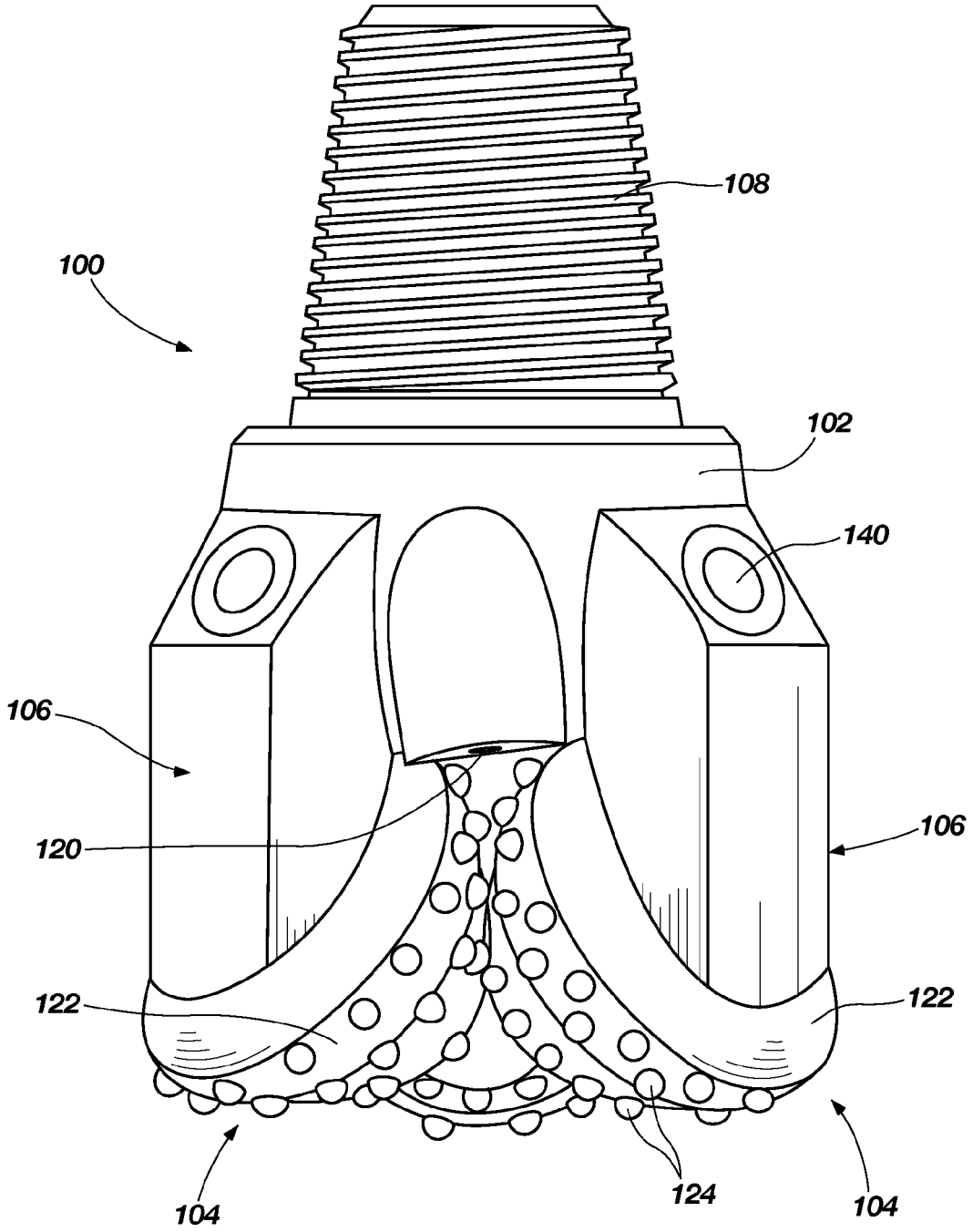
FIG. 1 is a side elevation view of an embodiment of a rolling-cutter drill bit that may include one or more components comprising a cast particle-matrix composite material including a eutectic or near-eutectic composition.

The illustrations presented herein are not actual views of any particular earth-boring tool, drill bit, or component of such a tool or bit, but are merely idealized representations that are employed to describe embodiments of the present disclosure.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes any element of an earth-boring tool that is used to cut or otherwise disintegrate formation material when the earth-boring tool is used to form or enlarge a bore in the formation.

As used herein, the terms "cone" and "roller cone" mean and include any body that comprises at least one formation-cutting structure that is mounted on a body of a rotary earth-boring tool, such as a rotary drill bit, in a rotatable manner, and that is configured to rotate relative to at least a portion of the body as the rotary earth-boring tool is rotated within a wellbore, and to remove formation material as the rotary earth-boring tool is rotated within a wellbore. Cones and roller cones may have a generally conical shape, but are not limited to structures having such a generally conical shape. Cones and roller cones may have shapes other than generally conical shapes.

In accordance with some embodiments of the present disclosure, earth-boring tools and/or components of earth-boring tools may comprise a cast particle-matrix composite material. The cast particle-matrix composite material may comprise a eutectic or near-eutectic composition. As used herein, the term "cast," when used in relation to a material, means a material that is formed within a mold cavity, such that a body formed to comprise the cast material is formed to comprise a shape at least substantially similar to the mold cavity in which the material is formed. Accordingly, the terms "cast" and "casting" are not limited to conventional casting, wherein a molten material is poured into a mold cavity, but encompass melting material in situ in a mold cavity. In addition, as is explained in more detail below, casting processes may be conducted at elevated pressure (greater than atmospheric pressure). Casting may also be performed at atmospheric pressure or at less than atmospheric pressure. As used herein, the term "near-eutectic composition" means within about ten atomic percent (10 at %) or less of a eutectic composition. As a non-limiting example, the cast particle-matrix composite material may comprise a eutectic or near-eutectic composition of cobalt and tungsten carbide. Examples of embodiments of earth-boring tools and components of earth-boring tools that may include a cast particle-matrix composite material comprising a eutectic or near-eutectic composition are described below.

Figure 2:
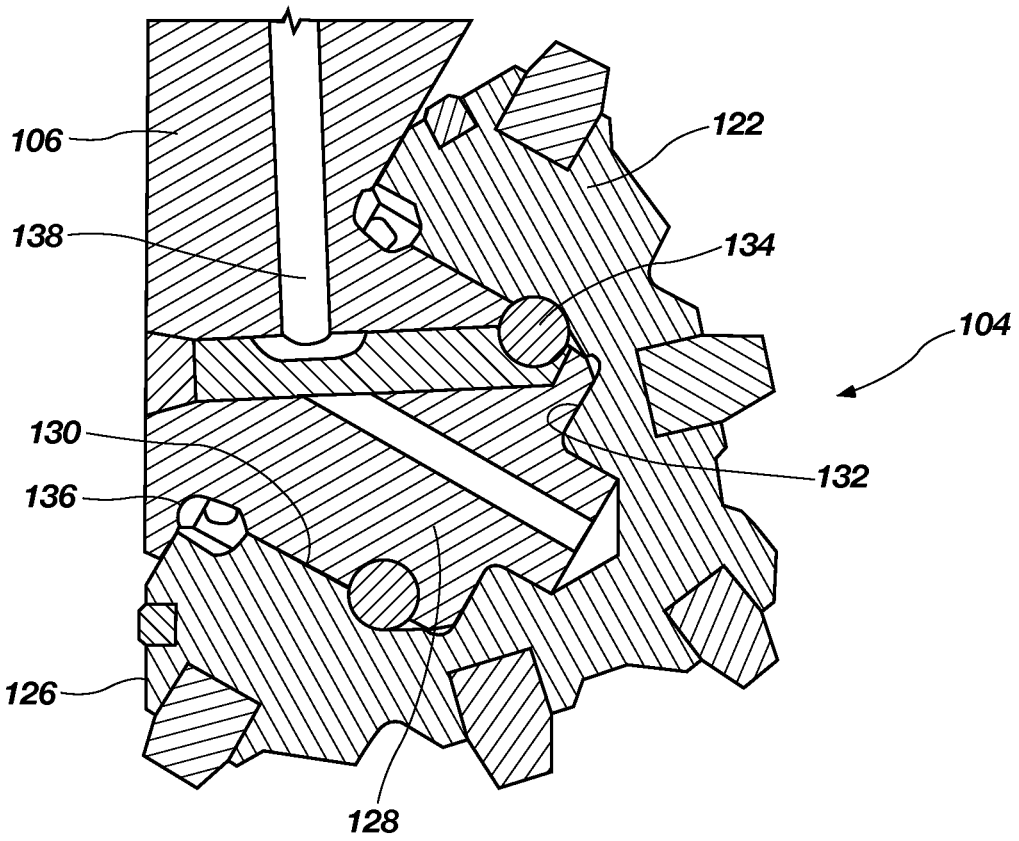
FIG. 2 is a partial sectional view of the drill bit of FIG. 1 and illustrates a rotatable cutter assembly that includes a roller cone.

FIG. 1 illustrates an embodiment of an earth-boring tool of the present disclosure. The earth-boring tool of FIG. 1 is a rolling-cutter earth-boring rotary drill bit 100. The drill bit 100 includes a bit body 102 and a plurality of rotatable cutter assemblies 104. The bit body 102 may include a plurality of integrally formed bit legs 106, and threads 108 may be formed on the upper end of the bit body 102 for connection to a drill string. The bit body 102 may have nozzles 120 for discharging drilling fluid into a borehole, which may be returned along with cuttings up to the surface during a drilling operation. Each of the rotatable cutter assemblies 104 includes a roller cone 122 comprising a particle-matrix composite material and a plurality of cutting elements, such as cutting inserts 124 shown. Each roller cone 122 may include a conical gage surface 126 (FIG. 2). Additionally, each roller cone 122 may have a unique configuration of cutting inserts 124 or cutting elements, such that the roller cones 122 may rotate in close proximity to one another without mechanical interference.

FIG. 2 is a cross-sectional view illustrating one of the rotatable cutter assemblies 104 of the earth-boring drill bit 100 shown in FIG. 1. As shown, each bit leg 106 may include a bearing pin 128. The roller cone 122 may be supported by the bearing pin 128, and the roller cone 122 may be rotatable about the bearing pin 128. Each roller cone 122 may have a central cavity 130 that may be generally cylindrical and may form a journal bearing surface adjacent the bearing pin 128. The cavity 130 may have a flat thrust shoulder 132 for absorbing thrust imposed by the drill string on the roller cone 122. As illustrated in this example, the roller cone 122 may be retained on the bearing pin 128 by a plurality of locking balls 134 located in mating grooves formed in the surfaces of the cone cavity 130 and the bearing pin 128. Additionally, a seal assembly 136 may seal the bearing spaces between the cone cavity 130 and the bearing pin 128. The seal assembly 136 may be a metal face seal assembly, as shown, or may be a different type of seal assembly, such as an elastomer seal assembly.

Lubricant may be supplied to the bearing spaces between the cavity 130 and the bearing pin 128 by lubricant passages 138. The lubricant passages 138 may lead to a reservoir that includes a pressure compensator 140 (FIG. 1).

At least one of the roller cones 122 and the bit legs 106 of the earth-boring drill bit 100 of FIGS. 1 and 2 may comprise a cast particle-matrix composite material comprising a eutectic or near-eutectic composition, and may be fabricated as discussed in further detail below.

Figure 3:
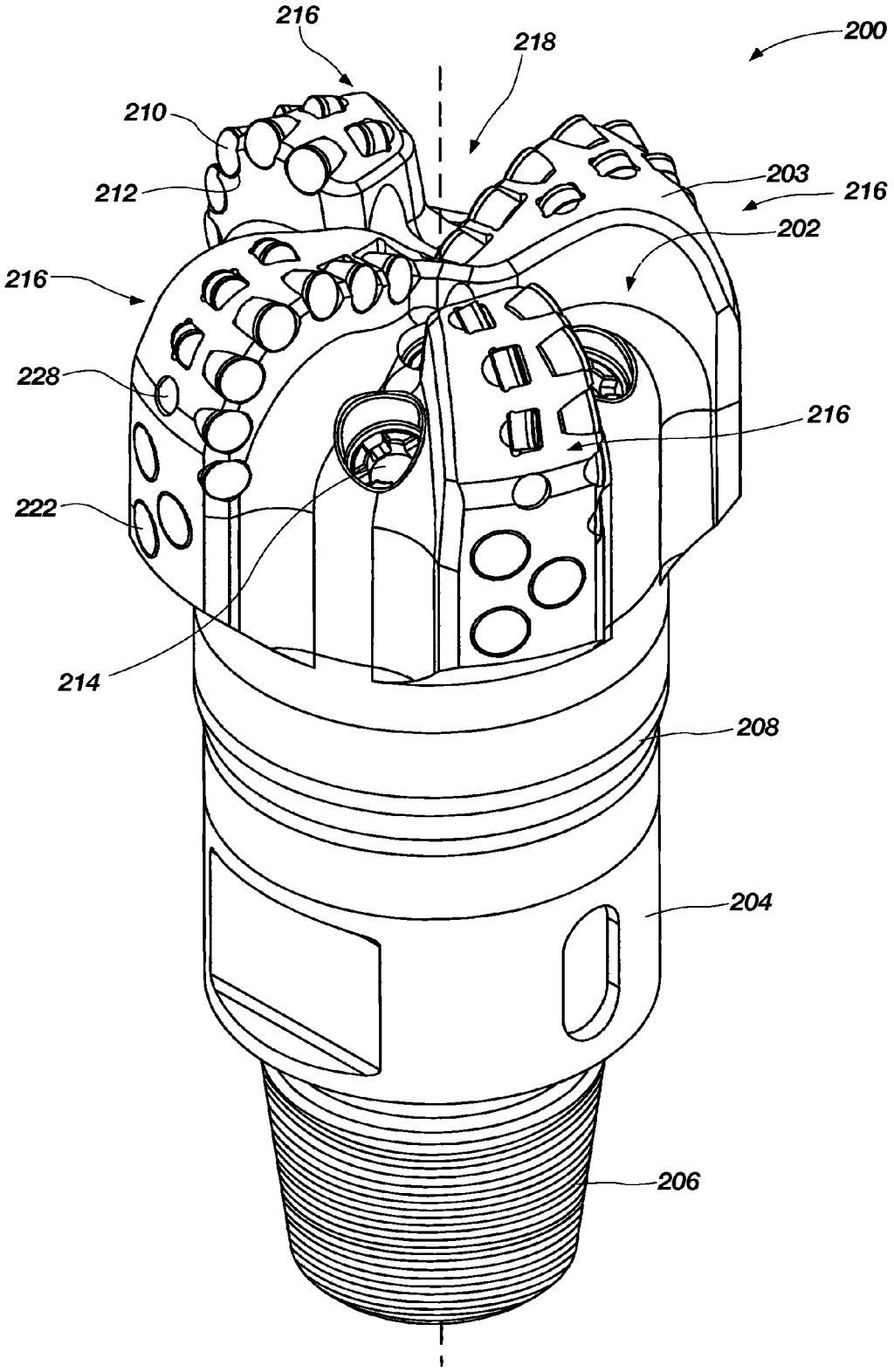
FIG. 3 is a perspective view of an embodiment of a fixed-cutter drill bit that may include one or more components comprising a cast particle-matrix composite material including a eutectic or near-eutectic composition.

FIG. 3 is a perspective view of a fixed-cutter earth-boring rotary drill bit 200 that includes a bit body 202 that may be formed using embodiments of methods of the present disclosure. The bit body 202 may be secured to a shank 204 having a threaded connection portion 206 (e.g., an American Petroleum Institute (API) threaded connection portion) for attaching the drill bit 200 to a drill string (not shown). In some embodiments, such as that shown in FIG. 3, the bit body 202 may be secured to the shank 204 using an extension 208. In other embodiments, the bit body 202 may be secured directly to the shank 204.

The bit body 202 may include internal fluid passageways (not shown) that extend between the face 203 of the bit body 202 and a longitudinal bore (not shown), which extends through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting elements 210 (which may include, for example, PDC cutting elements) may be mounted on the face 203 of the bit body 202 in cutting element pockets 212 that are located along each of the blades 216. The bit body 202 of the earth-boring rotary drill bit 200 shown in FIG. 3, or a portion of the bit body 202 (e.g., the blades 216 or portions of the blades 216) may comprise a cast particle-matrix composite material comprising a eutectic or near-eutectic composition, and may be fabricated as discussed in further detail below.

Figure 5:
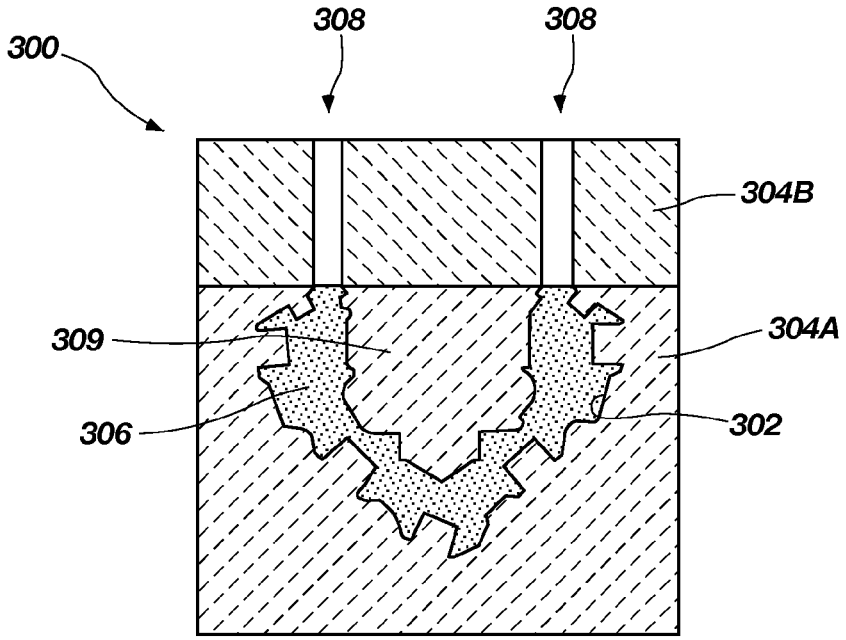
FIGS. 5 and 6 are used to illustrate embodiments of methods of the invention, and illustrate the casting of a roller cone like that shown in FIG. 2 within the mold shown in FIG. 4.
Figure 6:
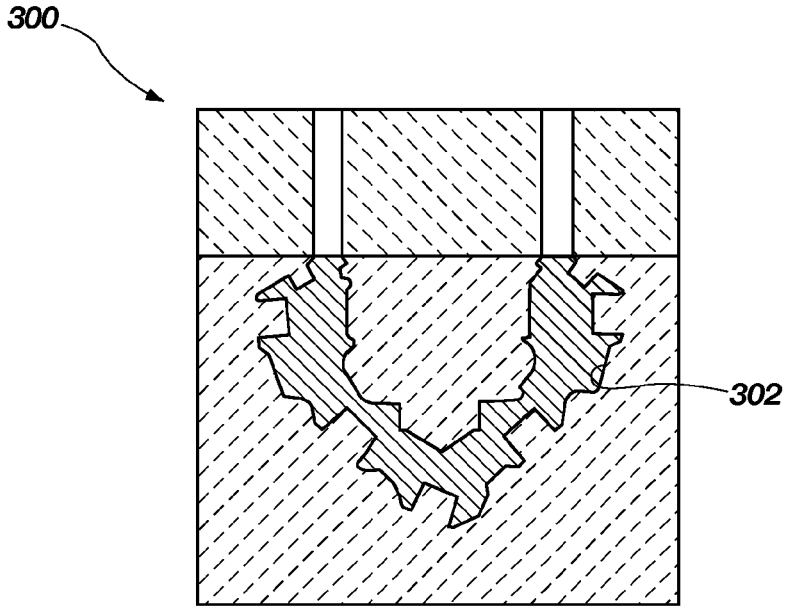

In accordance with some embodiments of the disclosure, earth-boring tools and/or components of earth-boring tools may be formed within a mold cavity using a casting process to cast a particle-matrix composite material comprising a eutectic or near-eutectic composition within the mold cavity. FIGS. 5 and 6 are used to illustrate the formation of a roller cone 122 like that shown in FIGS. 1 and 2 using such a casting process.

Figure 4:
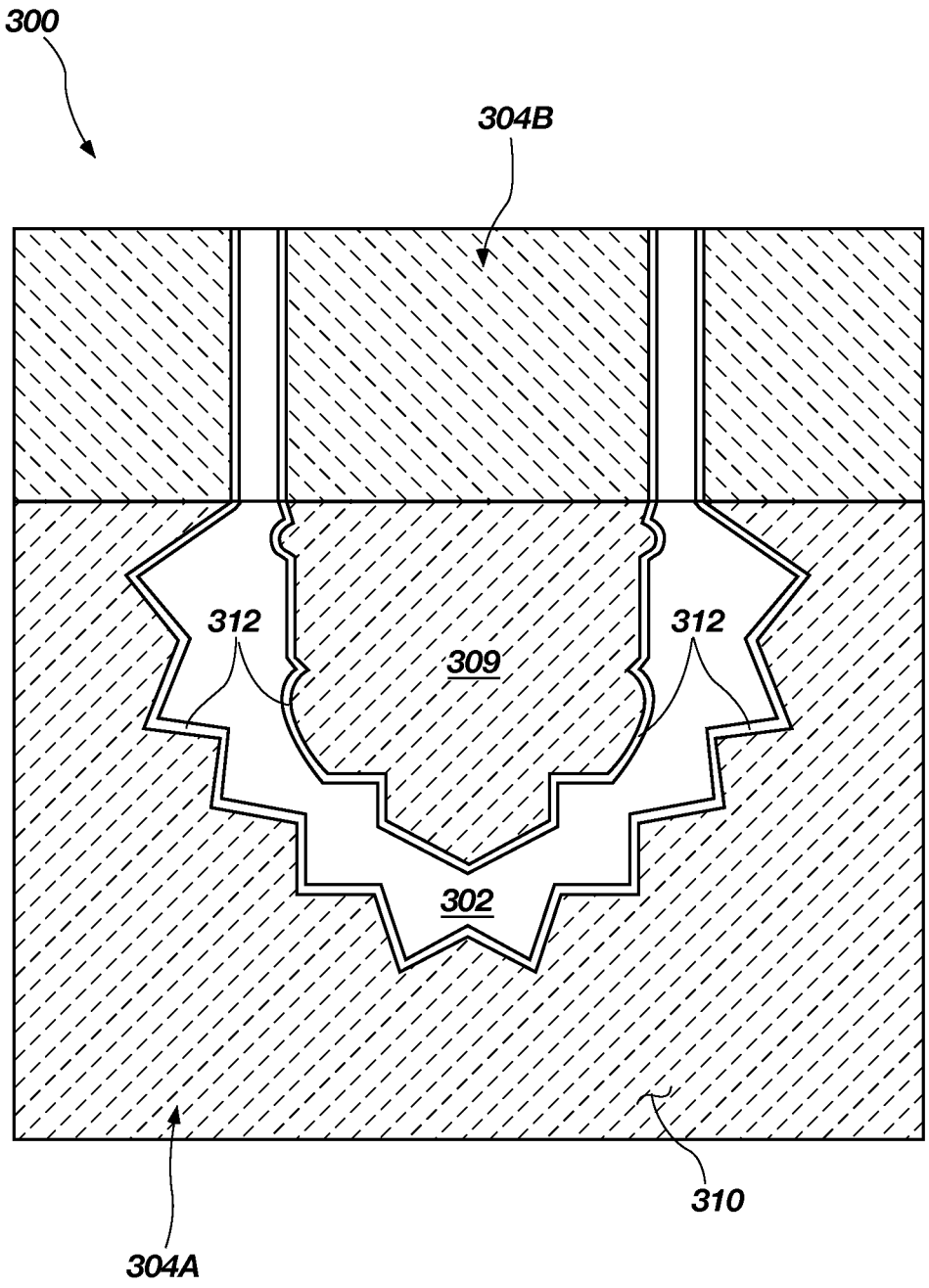
FIG. 4 illustrates coating material on interior cavity surfaces within a mold that may be used in accordance with embodiments of the invention.

Referring to FIG. 4, a mold 300 may be provided that includes a mold cavity 302 therein. The mold cavity 302 may have a size and shape corresponding to the size and shape of the roller cone 122 to be cast therein. The mold may comprise two or more components, such as a base portion 304A, and a top portion 304B, that may be assembled together to form the mold 300. A bearing pin displacement member 309 may be used to define an interior void within the roller cone 122 to be cast within the mold 300 that is sized and configured to receive a bearing pin therein when the roller cone 122 is mounted on the bearing pin. In some embodiments, the bearing pin displacement member 309 may comprise a separate body, as shown in FIG. 4. In other embodiments, the bearing pin displacement member 309 may be an integral part of the top portion 304B of the mold 300.

The mold 300 may comprise a material 310 that is stable and will not degrade at temperatures to which the mold 300 will be subjected during the casting process. In some embodiments, the material 310 of the mold 300 also may be selected to comprise a material that will not react with or otherwise detrimentally affect the material of the roller cone 122 to be cast within the mold cavity 302. After the casting process, it may be necessary to break or otherwise damage the mold 300 to remove the cast roller cone 122 from the mold cavity 302. Thus, the material 310 of the mold 300 also may be selected to comprise a material that is relatively easy to break or otherwise remove from around the roller cone 122 to enable the cast roller cone 122 to be removed from the mold 300.

For example, the material 310 of the mold 300 may comprise graphite. In additional embodiments, the material 310 of the mold 300 may comprise a ceramic material substantially free of carbon (i.e., a ceramic material that does not include carbon). For example, the material 310 of the mold 300 may comprise a ceramic oxide (e.g., zirconium oxide, silicon oxide, aluminum oxide, yttrium oxide, etc.). In additional embodiments, the material 310 of the mold 300 may comprise a chemically bonded phosphate ceramic (CBPC). CBPCs may be fabricated by acid-base reactions between inorganic oxides and either a phosphoric acid solution or an acid-phosphate solution. Examples of CBPCs that may be employed in the material 310 of the mold 300 include aluminum phosphates, calcium phosphates, magnesium phosphates, potassium phosphates, zinc phosphates, etc.

Graphite is a carbon material, and, if the material 310 comprises graphite, carbon may diffuse from the material 310 into the material of the roller cone 122 as the roller cone 122 is cast within the mold cavity 302. Such diffusion of carbon into the roller cone 122 from the material 310 of the mold 300 may, in some cases, adversely affect the properties of the cast roller cone 122. Furthermore, if the material 310 includes phosphorus or sulfur, these elements may also diffuse into the roller cone 122 and may adversely affect the properties of the cast roller cone 122. Further, some materials such as aluminum oxide may bond to the roller cone 122 during the casting process if the material 310 includes such materials.

Thus, as shown in FIG. 4, the surfaces of the mold 300 within the mold cavity 302 may be coated with a material 312 that does not include carbon and that will not react with or otherwise detrimentally affect the material of the roller cone 122 to be cast within the mold cavity 302. For example, the surfaces of the mold 300 within the mold cavity 302 may be coated with another ceramic material 312 that does not include carbon, such as a relatively inert ceramic oxide (e.g., zirconium oxide, silicon oxide, aluminum oxide, yttrium oxide, etc.).

The coating material 312 may be applied to surfaces of the mold 300 within the mold cavity 302 by, for example, preparing a liquid suspension or slurry that includes particles of a relatively inert ceramic material (such as those ceramic materials mentioned above) in a liquid. As a non-limiting example, the liquid suspension or slurry may comprise zirconium oxide ($ZrO_2$), such as the coating currently sold under the trade name ZIRCWASH, by ZYP® Coatings, Inc. of Oak Ridge, Tenn. The liquid suspension or slurry may be sprayed (e.g., using an aerosol), brushed, wiped, or otherwise applied to the surfaces of the mold 300 within the mold cavity 302. The suspension or slurry then may be dried to remove the liquid of the suspension or slurry, leaving the ceramic particles on the surfaces of the mold 300 within the mold cavity 302. The mold 300 may be heated (e.g., in a furnace) to facilitate drying of the suspension or slurry.

In additional embodiments, the mold cavity 302 may simply be filled with the liquid suspension or slurry, and subsequently emptied, leaving a coating of the liquid suspension or slurry on the surfaces of the mold 300 within the mold cavity 302.

Optionally, the ceramic particles that remain on the surfaces of the mold 300 within the mold cavity 302 may be at least partially sintered to affix the ceramic particles in place on the surfaces of the mold 300 within the mold cavity 302, and/or to reduce porosity in the resulting layer of coating material 312 on the surfaces of the mold 300 within the mold cavity 302.

In some embodiments, the coating material 312 may comprise multiple layers of coating material sequentially applied to the surfaces of the mold 300 within the mold cavity 302 by repeating the processes described above. In such embodiments, the layers may have compositions similar to or different from one another. For example, in some embodiments, one layer of the coating material 312 adjacent or proximate the surfaces of the mold 300 may comprise a barrier material selected and composed to prevent diffusion of one or more atomic species across the coating material 312 between the mold 300 and the roller cone 122. Another layer of the coating material 312 may include materials that are intended to react with the material of the roller cone 122 or otherwise affect a composition or microstructure of the roller cone 122. For example, such a layer of material may include one or more inoculants, as described in further detail below. As another example, such a layer of material may include one or more materials intended to form or incorporate material phases into the roller cone 122 to be cast within the mold cavity 302. For example, such a layer may include particles of tungsten carbide, or another hard material, that are intended to be incorporated into a roller cone 122 as the roller cone 122 is cast within the mold cavity 302.

The coating material 312 may be applied to the surfaces of the mold 300 within the mold cavity 302 as described above prior to casting the roller cone 122 within the mold cavity 302.

Particulate matter 306 (FIG. 5) comprising a hard material such as a carbide (e.g., tungsten carbide), a nitride, a boride, etc., optionally may be provided within the mold cavity 302. As used herein, the term "hard material" means and includes any material having a Vickers Hardness of at least about 1200 (i.e., at least about 1200HV30, as measured according to ASTM Standard E384 (Standard Test Method for Knoop and Vickers Hardness of Materials, ASTM Int'l, West Conshohocken, Pa., 2010)). By way of example and not limitation, the particulate matter 306 may include −80/+100 ASTM (American Society for Testing and Materials) mesh particles of tungsten carbide. As used herein, the phrase "−80/+100 ASTM mesh particles" means particles that pass through an ASTM No. 80 mesh screen, but do not pass through an ASTM No. 100 mesh screen, as defined in ASTM Specification E11-09 (Standard Specification for Wire Cloth and Sieves for Testing Purposes, ASTM Int'l, West Conshohocken, Pa., 2009). The particles of tungsten carbide may comprise one or more of cast tungsten carbide, sintered tungsten carbide, and macrocrystalline tungsten carbide.

After providing the particulate matter 306 within the mold cavity 302, a material comprising a eutectic or near-eutectic composition may be melted, and the molten material may be poured into the mold cavity 302 and allowed to infiltrate the space between the particulate matter 306 within the mold cavity 302 until the mold cavity 302 is at least substantially full. The molten material may be poured into the mold 300 through one or more openings 308 in the mold 300 that lead to the mold cavity 302.

In additional embodiments, no particulate matter 306 comprising hard material is provided within the mold cavity 302, and at least substantially the entire mold cavity 302 may be filled with the molten eutectic or near-eutectic composition to cast the roller cone 122 within the mold cavity 302.

In additional embodiments, particulate matter 306 comprising hard material is provided only at selected locations within the mold cavity 302 that correspond to regions of the roller cone 122 that are subjected to abrasive wear, such that those regions of the resulting roller cone 122 include a higher volume content of hard material compared to other regions of the roller cone 122 (formed from cast eutectic or near-eutectic composition without added particulate matter 306), which would have a lower volume content of hard material and exhibit a relatively higher toughness (i.e., resistance to fracturing).

In additional embodiments, the particulate matter 306 comprises both particles of hard material and particles of material or materials that will form a molten eutectic or near-eutectic composition upon heating the particulate matter 306 to a sufficient temperature to melt the material or materials that will form the molten eutectic or near-eutectic composition. In such embodiments, the particulate matter 306 is provided within the mold cavity 302. The mold cavity 302 may be vibrated to settle the particulate matter 306 to remove voids therein. The particulate matter 306 may be heated to a temperature sufficient to form the molten eutectic or near-eutectic composition. Upon formation of the molten eutectic or near-eutectic composition, the molten material may infiltrate the space between remaining solid particles in the particulate matter 306, which may result in settling of the particulate matter 306 and a decrease in occupied volume. Thus, excess particulate matter 306 also may be provided over the mold cavity 302 (e.g., within the openings 308 in the mold 300) to account for such settling that may occur during the casting process.

In accordance with some embodiments of the present disclosure, one or more inoculants may be provided within the mold cavity 302 to assist in controlling the nature of the resultant microstructure of the roller cone 122 to be cast within the mold cavity 302. As used herein, the term "inoculant" means and includes any substance that will control the growth of grains of at least one material phase upon cooling a eutectic or near-eutectic composition in a casting process. For example, inoculants may aid in limiting grain growth. For example, addition of an inoculant to the eutectic or near-eutectic composition can be used to refine the microstructure of the cast material (at least at the surface thereof) and improve the strength and/or wear characteristics of the surface of the cast material. By way of example and not limitation, such an inoculant may promote nucleation of grains. Such nucleation may cause adjacent grains to be closer together, thus limiting the amount of grain growth before adjacent grains interact. The final microstructure of a eutectic or near-eutectic composition comprising an inoculant may therefore be finer than a similar eutectic or near-eutectic composition without the inoculant. Inoculants may include, for example, cobalt aluminate, cobalt metasilicate, cobalt oxide, or a combination of such materials. Thus, the resulting microstructure may include grains having an average size that is reduced relative to the average size of the grains that would form in the absence of such an inoculant.

After casting the roller cone 122 within the mold cavity 302, the roller cone 122 may be removed from the mold 300. As previously mentioned, it may be necessary to break the mold 300 apart in order to remove the roller cone 122 from the mold 300.

The eutectic or near-eutectic composition may comprise a eutectic or near-eutectic composition of a metal and a hard material.

The metal of the eutectic or near-eutectic composition may comprise a commercially pure metal such as cobalt, iron, or nickel. In additional embodiments, the metal of the eutectic or near-eutectic composition may comprise an alloy based on one or more of cobalt, iron, and nickel. In such alloys, one or more elements may be included to tailor selected properties of the composition, such as strength, toughness, corrosion resistance, or electromagnetic properties.

The hard material of the eutectic or near-eutectic composition may comprise a ceramic compound, such as a carbide, a boride, an oxide, a nitride, or a mixture of one or more such ceramic compounds.

In some non-limiting examples, the metal of the eutectic or near-eutectic composition may comprise a cobalt-based alloy, and the hard material may comprise tungsten carbide. For example, the eutectic or near-eutectic composition may comprise from about 40% to about 90% cobalt or cobalt-based alloy by weight, from about 0.5 percent to about 3.8 percent by weight carbon, and the balance may be tungsten. In a further example, the eutectic or near-eutectic composition may comprise from about 55% to about 85% cobalt or cobalt-based alloy by weight, from about 0.85 percent to about 3.0 percent carbon by weight, and the balance may be tungsten. Even more particularly, the eutectic or near-eutectic composition may comprise from about 65% to about 78% cobalt or cobalt-based alloy by weight, from about 1.3 percent to about 2.35 percent carbon by weight, and the balance may be tungsten. For example, the eutectic or near-eutectic composition may comprise about 69% cobalt or cobalt-based alloy by weight (about 78.8 atomic percent cobalt), about 1.9% carbon by weight (about 10.6 atomic percent carbon), and about 29.1% tungsten by weight (about 10.6 atomic percent tungsten). As another example, the eutectic or near-eutectic composition may comprise about 75% cobalt or cobalt-based alloy by weight, about 1.53% carbon by weight, and about 23.47% tungsten by weight.

Once the eutectic or near-eutectic composition is heated to the molten state, the metal and hard material phases will not be distinguishable in the molten composition, which will simply comprise a generally homogeneous molten solution of the various elements. Upon cooling and solidification of the molten composition, however, phase segregation may occur and the metal phase and hard material phase may segregate from one another and solidify to form a composite microstructure that includes regions of the metal phase and regions of the hard material phase. Furthermore, in embodiments in which particulate matter 306 is provided within the mold 300 prior to casting the eutectic or near-eutectic composition in the mold cavity 302, additional phase regions resulting from the particulate matter 306 may also be present in the final microstructure of the resulting cast roller cone 122.

As the molten eutectic or near-eutectic composition is cooled to a solid state and phase segregation occurs, metal and hard material phases may be formed again. Hard material phases may include metal carbide phases. For example, such metal carbide phases may be of the general formula $M_6C$ and $M_{12}C$, wherein M represents one or more metal elements and C represents carbon. As a particular example, in embodiments wherein a desirable hard material phase to be formed is monotungsten carbide (WC), the eta phases of the general formula $W_xCo_yC$ also may be formed, wherein x is from about 0.5 to about 6 and y is from about 0.5 to about 6 (e.g., $W_3Co_3C$ and $W_6Co_6C$). Such metal carbide eta phases tend to be relatively wear-resistant, but also more brittle compared to the primary carbide phase (e.g., WC). Thus, such metal carbide eta phases may be undesirable for some applications. In accordance with some embodiments of the disclosure, a carbon correction cycle may be used to adjust the stoichiometry of the resulting metal carbide phases in such a manner as to reduce (e.g., at least substantially eliminate) the resulting amount of such undesirable metal carbide eta phases (e.g., $M_6C$ and $M_{12}C$) in the cast roller cone 122 and increase the resulting amount of a desirable primary metal carbide phase (e.g., MC and/or $M_2C$) in the cast roller cone 122. By way of example and not limitation, a carbon correction cycle as disclosed in U.S. Pat. No. 4,579,713, which issued Apr. 1, 1986 to Lueth, the disclosure of which is incorporated herein in its entirety by this reference, may be used to adjust the stoichiometry of the resulting metal carbide phases in the cast roller cone 122.

Briefly, the roller cone 122 (or the mold 300 with the materials to be used to form the roller cone 122 therein) may be provided in a vacuum furnace together with a carbon-containing substance, and then heated to a temperature within a range extending from about 800° C. to about 1100° C., while maintaining the furnace under vacuum. A mixture of hydrogen and methane then may be introduced into the furnace. The percentage of methane in the mixture may be from about 10% to about 90% of the quantity of methane needed to obtain equilibrium of the following equation at the temperature and pressure within the furnace:

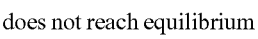

$$C_{solid}+2H_2 \leftrightarrow CH_4$$

Following the introduction of the hydrogen and methane mixture into the furnace chamber, the furnace chamber is maintained within the selected temperature and pressure range for a time period sufficient for the following reaction:

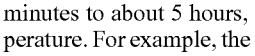

$$MC+2H_2 \leftrightarrow M+CH_4,$$

where M may be selected from the group of W, Ti, Ta, Hf and Mo, to substantially reach equilibrium, but in which the reaction:

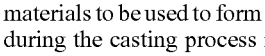

$$C_{solid}+2H_2 \leftrightarrow CH_4,$$

does not reach equilibrium either due to the total hold time or due to gas residence time but, rather, the methane remains within about 10% to about 90% of the amount needed to obtain equilibrium. This time period may be from about 15 minutes to about 5 hours, depending upon the selected temperature. For example, the time period may be approximately 90 minutes at a temperature of about 1000° C. and a pressure of about one atmosphere.

The carbon correction cycle may be performed on the materials to be used to form the cast roller cone 122 prior to or during the casting process in such a manner as to hinder or prevent the formation of the undesirable metal carbide eta phases (e.g., $M_6C$ and $M_{12}C$) in the cast roller cone 122. In additional embodiments, it may be possible to perform the carbon correction cycle after the casting process in such a manner as to convert undesirable metal carbide phases previously formed in the roller cone 122 during the casting process to more desirable metal carbide phases (e.g., MC and/or $M_2C$), although such conversion may be limited to regions at or proximate the surface of the roller cone 122.

In additional embodiments, an annealing process may be used to adjust the stoichiometry of the resulting metal carbide phases in such a manner as to reduce (e.g., at least substantially eliminate) the resulting amount of such undesirable metal carbide phases (e.g., $M_6C$ and $M_{12}C$) in the cast roller cone 122 and increase the amount of a desirable primary metal carbide phase (e.g., MC and/or $M_2C$) in the cast roller cone 122. For example, the cast roller cone 122 may be heated in a furnace to a temperature of at least about 1200° C. (e.g., about 1225° C.) for at least about three hours (e.g., about six hours or more). The furnace may comprise a vacuum furnace, and a vacuum may be maintained within the furnace during the annealing process. For example, a pressure of about 0.015 millibar may be maintained within the vacuum furnace during the annealing process. In additional embodiments, the furnace may be maintained at about atmospheric pressure, or it may be pressurized, as discussed in further detail below. In such embodiments, the atmosphere within the furnace may comprise an inert atmosphere. For example, the atmosphere may comprise nitrogen or a noble gas.

During the processes described above for adjusting the stoichiometry of metal carbide phases within the roller cone 122, free carbon (e.g., graphite) that is present in or adjacent the roller cone 122 also may be absorbed and combined with metal (e.g., tungsten) to form a metal carbide phase (e.g., tungsten carbide), or combined into existing metal carbide phases.

Annealing processes as discussed above may also be used to adjust morphology of the microstructure of the roller cone 122.

In some embodiments, a hot isostatic pressing (HIP) process may be used to increase the density and decrease porosity in the cast roller cone 122. For example, during the casting process, an inert gas may be used to pressurize a chamber in which the casting process may be conducted. The pressure may be applied during the casting process, or after the casting process but prior to removing the cast roller cone 122 from the mold 300. In additional embodiments, the cast roller cone 122 may be subjected to an HIP process after removing the cast roller cone 122 from the mold 300. By way of example, the cast roller cone 122 may be heated to a temperature from about 300° C. to about 1200° C. while applying an isostatic pressure to exterior surfaces of the roller cone 122 of from about 7.0 MPa to about 310,000 MPa (about 1 ksi to about 45,000 ksi). Furthermore, a carbon correction cycle as discussed hereinabove may be incorporated into the HIP process such that the carbon correction cycle is performed either immediately before or immediately after the HIP process in the same furnace chamber used for the HIP process.

In additional embodiments, a cold isostatic pressing process may be used to increase the density and decrease porosity in the cast roller cone 122. In other words, the cast roller cone 122 may be subjected to isostatic pressures of at least about 10,000 MPa while maintaining the roller cone 122 at a temperature of about 300° C. or less.

After forming the roller cone 122, the roller cone 122 may be subjected to one or more surface treatments. For example, a peening process (e.g., a shot peening process, a rod peening process, or a hammer peening process) may be used to impart compressive residual stresses within the surface regions of the roller cone 122. Such residual stresses may improve the mechanical strength of the surface regions of the roller cone 122, and may serve to hinder cracking in the roller cone 122 during use in drilling that might result from, for example, fatigue.

In accordance with some embodiments of the disclosure, inserts may be provided within a mold cavity prior to casting an earth-boring tool or a component of an earth-boring tool within the mold cavity using a eutectic or near-eutectic composition, as discussed above.

Figure 7:
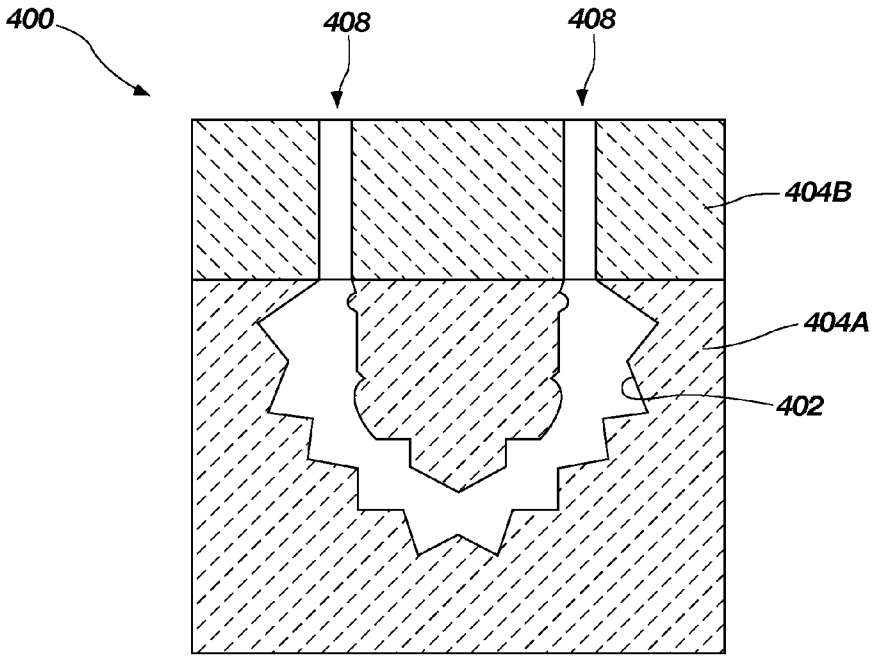
FIGS. 7 through 10 are used to illustrate additional embodiments of methods of the invention, and also illustrate the casting of a roller cone like that shown in FIG. 2 within a mold like that shown in FIG. 4.

For example, FIG. 7 illustrates another mold 400 that is generally similar to the mold 300 previously described in relation to FIGS. 5 and 6. The mold 400 includes a mold cavity 402 therein. The mold cavity 402 may have a size and shape corresponding to the size and shape of the cone 500 (FIG. 10) to be cast therein. As shown in FIG. 7, the mold 400 may comprise two or more components, such as a base portion 404A, and a top portion 404B, that may be assembled together to form the mold 400.

The mold 400 may comprise a material as described above in relation to the mold 300 of FIGS. 4 through 6. Interior surfaces of the mold 400 within the mold cavity 402 also may be coated as described above in relation to the mold 300 of FIGS. 4 through 6.

Figure 8:
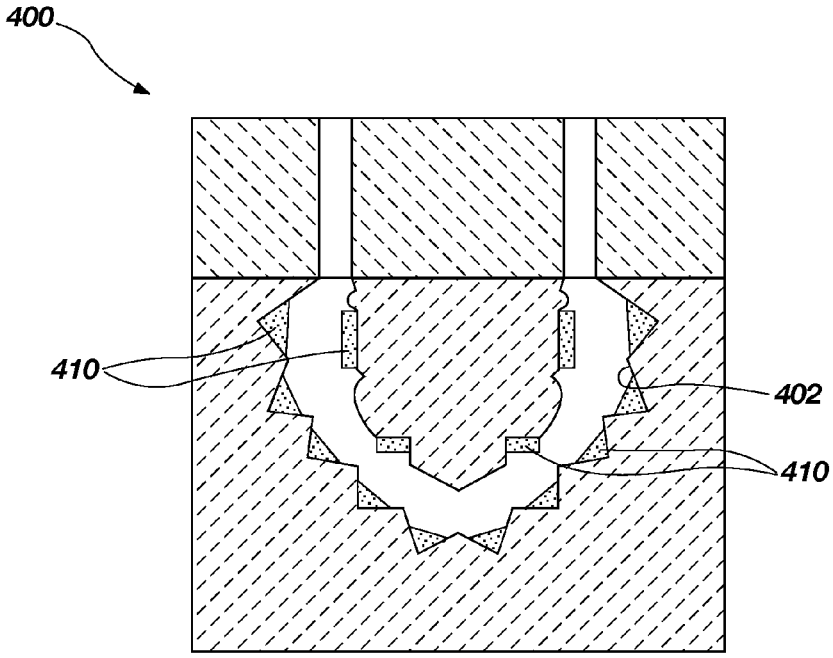

Referring to FIG. 8, inserts 410 may be provided at selected locations within the mold cavity 402 prior to the casting process. The inserts 410 may comprise, for example, a material that is more resistant to wear relative to the material to be cast within the mold cavity 402 over and around the inserts 410. For example, the inserts 410 may comprise a fully sintered particle-matrix composite material (i.e., sintered to a desirable final density) that includes hard particles within a metal or metal alloy matrix material. The inserts 410 may comprise a cemented carbide that includes hard carbide particles (e.g., tungsten carbide particles) cemented within a metal or metal alloy matrix material (e.g., iron, cobalt, nickel, or an alloy based on one or more of iron, cobalt, and nickel).

Such inserts 410 may comprise, for example, from about four percent (4%) to about twenty percent (20%) by weight metal or metal alloy matrix material, and from about ninety-six percent (96%) to about eighty percent (80%) by weight hard particles. As a non-limiting example, the hard particles in the inserts 410 may have an average particle size of from about two microns (2 μm) to about ten microns (10 μm). In additional embodiments, the inserts 410 may be at least substantially comprised of a metal or metal alloy. For example, the inserts 410 may be at least substantially comprised of iron, cobalt, nickel, or an alloy based on one or more of iron, cobalt, and nickel.

In some embodiments, the inserts 410 may comprise less-than-fully sintered bodies (e.g., unsintered green bodies or partially sintered brown bodies) that will sinter as a material is cast within the mold cavity 402 over and around the inserts 410. In such embodiments, the inserts 410 may undergo sintering during the subsequent casting process and/or they may be infiltrated by the molten composition during the subsequent casting process.

The inserts 410 may be shaped by hand or by a machining process. In some embodiments, inserts 410 may be formed using a separate casting process, or may be pressed in a die or mold.

The inserts 410 may be provided at selected locations within the mold cavity 402 that correspond to regions within a cone 500 (FIG. 10) to be formed therein that may be subjected to abrasive wear as the cone 500 is used to drill a wellbore. For example, the inserts 410 may be provided at locations within the mold cavity 402 that correspond to cutting tooth regions on the cone 500, and/or at locations within the mold cavity 402 that correspond to bearing surfaces on the cone 500 that will bear against a bearing pin, such as the bearing pin 128 shown in FIG. 2.

Figure 9:
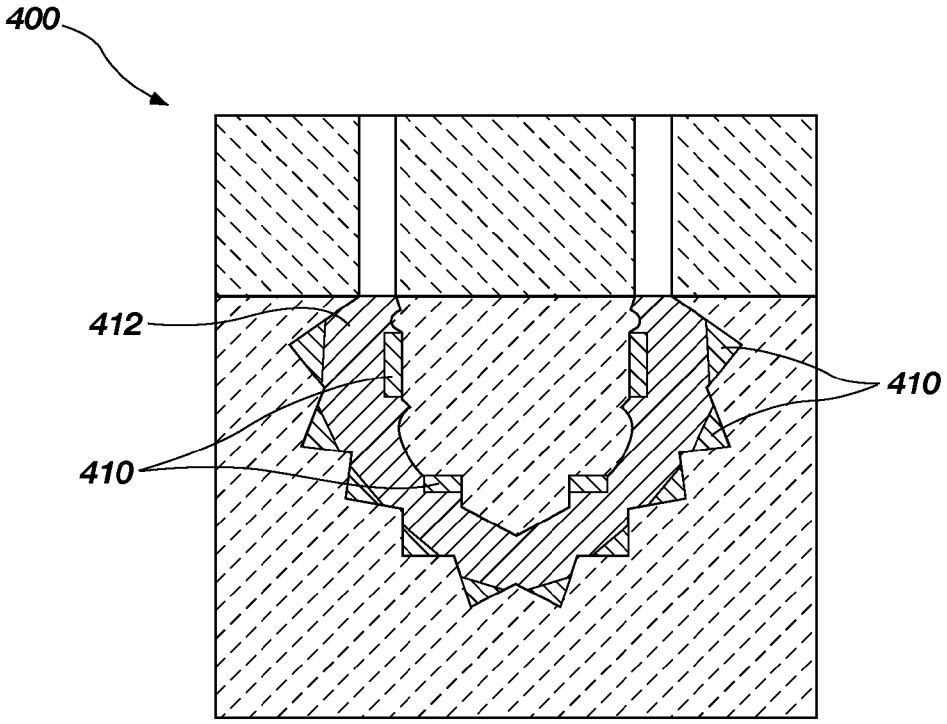

Referring to FIG. 9, after providing the inserts 410 within the mold cavity 402, a body portion 412 of a cone 500 (FIG. 10) may be cast within the mold cavity 402 over and around the inserts 410. During the casting process, the body portion 412 may bond to each of the inserts 410, such that the inserts 410 may be embedded in and integrally formed with the body portion 412. The body portion 412 may comprise a eutectic or near-eutectic composition, as described above.

Prior to the casting process, the mold 400 may be preheated to a temperature of at least about three hundred degrees Celsius (300° C.) (e.g., about 345° C.) at a ramp rate of between about thirty degrees Celsius per hour (30° C./hr) and about one hundred degrees Celsius per hour (100° C./hr) (e.g., about 65° C./hour). Such a pre-heat process may accelerate removal (e.g., evaporation) of moisture or other volatile substances prior to the casting process. In embodiments in which the inserts 410 comprise less-than-fully sintered bodies (e.g., unsintered green bodies or partially sintered brown bodies), such a pre-heat process also may drive off volatile substances (e.g., organic binders, plasticizers, etc.) that may be present in the inserts 410.

Optionally, particulate matter 306 (FIG. 5) comprising a hard material such as a carbide (e.g., tungsten carbide) may be provided within the mold cavity 402. After providing the particulate matter 306 within the mold cavity 402, a material comprising a eutectic or near-eutectic composition may be melted, and the molten material may be poured into the mold cavity 402 and allowed to infiltrate the space between the particulate matter 306 within the mold cavity 402 until the mold cavity 402 is at least substantially full. The molten material may be poured into the mold 400 through one or more openings 408 in the mold 400 that lead to the mold cavity 402.

In additional embodiments, no particulate matter 306 comprising hard material is provided within the mold cavity 402, and at least substantially the entire mold cavity 402 may be filled with the molten eutectic or near-eutectic composition to cast the body portion 412 of the cone 500 (FIG. 10) within the mold cavity 402.

In additional embodiments, particulate matter 306 comprising hard material is provided only at selected locations within the mold cavity 402 that correspond to regions of the roller cone 122 that are subjected to abrasive wear, such that those regions of the resulting cone 500 include a higher volume content of hard material compared to other regions of the cone 500 (formed from cast eutectic or near-eutectic composition without added particulate matter 306), which would have a lower volume content of hard material and exhibit a relatively higher toughness.

In additional embodiments, the particulate matter 306 comprises both particles of hard material and particles of material or materials that will form a molten eutectic or near-eutectic composition upon heating the particulate matter 306 to a sufficient temperature to melt the material or materials that will form the molten eutectic or near-eutectic composition. In such in situ casting methods, the particulate matter 306 is provided within the mold cavity 402 and heated to a temperature sufficient to form the molten eutectic or near-eutectic composition. Upon formation of the molten eutectic or near-eutectic composition, the molten material will infiltrate the space between remaining solid particles in the particulate matter 306, which will result in settling of the particulate matter 306 and a decrease in occupied volume. Thus, excess particulate matter 306 also may be provided over the mold cavity 402 (e.g., within the openings 408 in the mold) to account for such settling that may occur during the casting process.

For example, in embodiments in which the eutectic or near-eutectic composition is to comprise a eutectic or near-eutectic composition of cobalt and tungsten carbide, the eutectic or near-eutectic composition may have a melting point of about 1320° C., although the material or materials that will form the molten eutectic or near-eutectic composition may not melt at precisely 1320° C. due to the segregated phases therein. However, upon formation of the molten eutectic or near-eutectic composition, the molten eutectic or near-eutectic composition may solidify at or near the melting point of 1320° C. upon cooling. In such embodiments, the mold 400, including the particles of material or materials that will form the molten eutectic or near-eutectic composition within the mold cavity 402, may be heated to a peak temperature of at least about 1350° C., at least about 1375° C., or even at least about 1400° C. (e.g., 1450° C.) to ensure that the particles of material or materials that will form the molten eutectic or near-eutectic composition actually do melt and form the molten eutectic or near-eutectic composition (as opposed to simply undergoing densification due to sintering mechanisms). Optionally, the mold 400, including the particles of material or materials that will form the molten eutectic or near-eutectic composition within the mold cavity 402, may be heated to the peak temperature in a furnace by heating the furnace to the peak temperature at a ramp rate of from about 1° C. per minute to about 20° C. per minute. For example, the furnace may be heated from the pre-heat temperature (e.g., about 345° C.) to about 1400° C. at a ramp rate of about 2° C. per minute. The furnace temperature may be maintained at the peak temperature from about one minute (1 min) to about one hundred twenty minutes (120 min) (e.g., about 60 min).

One or more inoculants optionally may be provided within the mold cavity 402 to assist in controlling the nature of the resultant microstructure of the cone 500 to be cast within the mold cavity 402, as previously discussed in relation to FIGS. 5 and 6.

Figure 10:
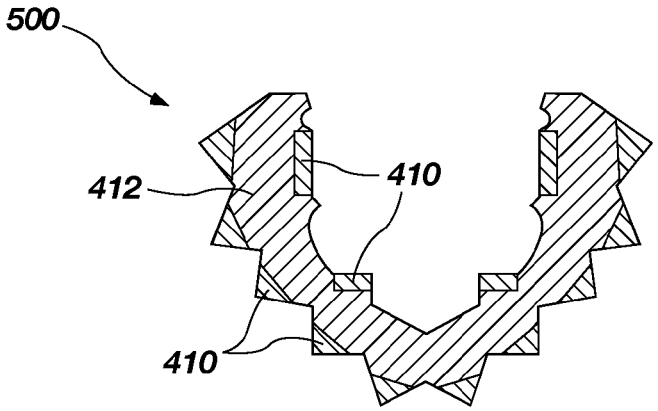

After casting the cone 500 within the mold cavity 402, the cone 500 may be removed from the mold 400, as shown in FIG. 10. As previously mentioned, it may be necessary to break the mold 400 apart in order to remove the cone 500 from the mold 400.

The eutectic or near-eutectic composition may comprise a eutectic or near-eutectic composition of a metal and a hard material, as previously described herein.

As the molten eutectic or near-eutectic composition is cooled and phase segregation occurs, mixed metal carbide phases may be formed. Thus, in accordance with some embodiments of the disclosure, a carbon correction cycle may be used to adjust the stoichiometry of the resulting metal carbide phases in such a manner as to reduce (e.g., at least substantially eliminate) the resulting amount of such undesirable metal carbide phases in the cast cone 500 and increase the resulting amount of a desirable primary metal carbide phase in the cast cone 500, as previously discussed in relation to the roller cone 122 and FIGS. 5 and 6.

In some embodiments, a hot isostatic pressing (HIP) process may be used to increase the density and decrease porosity in the cast cone 500. For example, during the casting process, an inert gas may be used to pressurize a chamber in which the casting process may be conducted. The pressure may be applied during the casting process, or after the casting process but prior to removing the cast cone 500 from the mold 400. In additional embodiments, the cast cone 500 may be subjected to an HIP process after removing the cast cone 500 from the mold 400. Furthermore, a carbon correction cycle as discussed hereinabove may be incorporated into the HIP process such that the carbon correction cycle is performed either immediately before or immediately after the HIP process in the same furnace chamber used for the HIP process.

In additional embodiments, a cold isostatic pressing process may be used to increase the density and decrease porosity in the cast cone 500. In other words, the cast cone 500 may be subjected to isostatic pressures of at least about 10,000 MPa while maintaining the cone 500 at a temperature of about 300° C. or less.

After forming the cone 500, the cone 500 may be subjected to one or more surface treatments. For example, a peening process (e.g., a shot peening process, a rod peening process, or a hammer peening process) may be used to impart compressive residual stresses within the surface regions of the cone 500. Such residual stresses may improve the mechanical strength of the surface regions of the cone 500, and may serve to hinder cracking in the cone 500 during use in drilling that might result from, for example, fatigue.

Casting of articles can enable the formation of articles having relatively complex geometric configurations that may not be attainable by other fabrication methods. Thus, by casting earth-boring tools and/or components of earth-boring tools as disclosed herein, earth-boring tools and/or components of earth-boring tools may be formed that have designs that are relatively more geometrically complex compared to previously fabricated earth-boring tools and/or components of earth-boring tools.

Additional non-limiting example embodiments of the disclosure are described below.

Embodiment 1

A method of forming at least a portion of an earth-boring tool comprising providing at least one insert in a mold cavity, providing particulate matter comprising a hard material in the mold cavity, melting a metal and the hard material to form a molten composition comprising a eutectic or near-eutectic composition of the metal and the hard material, and casting the molten composition within the mold cavity.

Embodiment 2

The method of Embodiment 1, further comprising providing an inoculant within the mold cavity.

Embodiment 3

The method of Embodiment 2, wherein providing an inoculant within the mold cavity comprises providing an inoculant within the mold cavity to control grain growth as the molten composition comprising the eutectic or near eutectic composition of the metal and the hard material solidifies.

Embodiment 4

The method of Embodiment 2 or Embodiment 3, wherein providing the inoculant comprises providing at least one of a transition metal aluminate, a transition metal metasilicate, and a transition metal oxide.

Embodiment 5

The method of any of Embodiments 2 through 4, wherein providing the inoculant comprises providing at least one of cobalt aluminate, cobalt metasilicate, and cobalt oxide.

Embodiment 6

The method of any of Embodiments 2 through 5, wherein melting a metal and a hard material to form a molten composition comprises forming a eutectic or near-eutectic composition of cobalt and tungsten carbide.

Embodiment 7

The method of any of Embodiments 1 through 6, further comprising adjusting a stoichiometry of at least one hard material phase of the at least a portion of the earth-boring tool.

Embodiment 8

The method of Embodiment 7, wherein adjusting a stoichiometry of at least one hard material phase of the at least a portion of the earth-boring tool comprises converting at least one of an $M_6C$ phase and an $M_{12}C$ phase to at least one of an MC phase and an $M_2C$ phase, wherein M is at least one metal element and C is carbon.

Embodiment 9

The method of Embodiment 8, wherein converting at least one of an $M_6C$ phase and an $M_{12}C$ phase to at least one of an MC phase and an $M_2C$ phase comprises converting $W_xCo_yC$ to WC, wherein x is from about 0.5 to about 6 and y is from about 0.5 to about 6.

Embodiment 10

The method of any of Embodiments 1 through 9, wherein melting a metal and a hard material to form a molten composition comprises melting a mixture comprising from about 40% to about 90% cobalt or cobalt-based alloy by weight and from about 0.5% to about 3.8% carbon by weight, wherein a balance of the mixture is at least substantially comprised of tungsten.

Embodiment 11

The method of any of Embodiments 1 through 10, wherein melting a metal and a hard material to form a molten composition comprises melting a mixture comprising from about 55% to about 85% cobalt or cobalt-based alloy by weight and from about 0.85% to about 3.0% carbon by weight, wherein a balance of the mixture is at least substantially comprised of tungsten.

Embodiment 12

The method of any of Embodiments 1 through 11, wherein melting a metal and a hard material to form a molten composition comprises melting a mixture comprising from about 65% to about 78% cobalt or cobalt-based alloy by weight and from about 1.3% to about 2.35% carbon by weight, wherein a balance of the mixture is at least substantially comprised of tungsten.

Embodiment 13

The method of any of Embodiments 1 through 12, wherein melting a metal and a hard material to form a molten composition comprises melting a mixture comprising about 69% cobalt or cobalt-based alloy by weight, about 1.9% carbon by weight, and about 29.1% tungsten by weight.

Embodiment 14

The method of any of Embodiments 1 through 12, wherein melting a metal and a hard material to form a molten composition comprises melting a mixture comprising about 75% cobalt or cobalt-based alloy by weight, about 1.53% carbon by weight, and about 23.47% tungsten by weight.

Embodiment 15

The method of any of Embodiments 1 through 14, further comprising pressing the at least a portion of the earth-boring tool after casting the molten composition within the mold cavity.

Embodiment 16

The method of any of Embodiments 1 through 15, further comprising treating at least a surface region of the at least a portion of the earth-boring tool to provide residual compressive stresses within the at least a surface region of the at least a portion of the earth-boring tool.

Embodiment 17

The method of Embodiment 16, wherein treating at least the surface region of the at least a portion of the earth-boring tool comprises subjecting the at least a surface region of the at least a portion of the earth-boring tool to a peening process.

Embodiment 18

The method of any of Embodiments 1 through 17, wherein providing the at least one insert in the mold cavity comprises providing a particle-matrix composite material exhibiting a wear-resistance greater than a wear resistance of the solidified molten composition.

Embodiment 19

The method of any of Embodiments 1 through 18, wherein providing the at least one insert in the mold cavity comprises providing a less-than-fully sintered body.

Embodiment 20

The method of any of Embodiments 1 through 19, wherein providing the at least one insert in the mold cavity comprises positioning the at least one insert at a location within the mold cavity corresponding to at least one of a cutting surface and a bearing surface of the at least a portion of an earth-boring tool to be formed within the mold cavity.

Embodiment 21

A method of forming a roller cone of an earth-boring rotary drill bit comprising providing at least one insert within a mold cavity, forming a molten composition comprising a eutectic or near-eutectic composition of cobalt and tungsten carbide, casting the molten composition within the mold cavity adjacent at least a portion of the at least one insert, and solidifying the molten composition within the mold cavity.

Embodiment 22

The method of Embodiment 21, further comprising converting at least one of a $W_3Co_3C$ phase region and a $W_6Co_6C$ phase region within the roller cone to at least one of WC and $W_2C$.

Embodiment 23

The method of Embodiment 21 or Embodiment 22, wherein forming a molten composition comprises forming a molten composition comprising from about 40% to about 90% cobalt or cobalt-based alloy by weight and from about 0.5% to about 3.8% carbon by weight, wherein a balance of the mixture is at least substantially comprised of tungsten.

Embodiment 24

The method of any of Embodiments 21 through 23, wherein forming a molten composition comprises forming a molten composition comprising from about 55% to about 85% cobalt or cobalt-based alloy by weight and from about 0.85% to about 3.0% carbon by weight, wherein a balance of the mixture is at least substantially comprised of tungsten.

Embodiment 25

The method of any of Embodiments 21 through 24, wherein forming a molten composition comprises forming a molten composition comprising from about 65% to about 78% cobalt or cobalt-based alloy by weight and from about 1.3% to about 2.35% carbon by weight, wherein a balance of the mixture is at least substantially comprised of tungsten.

Embodiment 26

The method of any of Embodiments 21 through 25, wherein forming a molten composition comprises forming a molten composition comprising about 69% cobalt or cobalt-based alloy by weight, about 1.9% carbon by weight, and about 29.1% tungsten by weight.

Embodiment 27

The method of any of Embodiments 21 through 25, wherein forming a molten composition comprises forming a molten composition comprising about 75% cobalt or cobalt-based alloy by weight, about 1.53% carbon by weight, and about 23.47% tungsten by weight.

Embodiment 28

The method of any of Embodiments 21 through 27, further comprising using an inoculant to control grain growth as the molten composition solidifies within the mold cavity.

Embodiment 29

The method of Embodiment 28, wherein using an inoculant to control grain growth comprises adding at least one of a transition metal aluminate, a transition metal metasilicate, and a transition metal oxide to the mold cavity.

Embodiment 30

The method of Embodiment 28 or Embodiment 29, wherein using an inoculant to control grain growth comprises adding at least one of cobalt aluminate, cobalt metasilicate, and cobalt oxide to the mold cavity.

Embodiment 31

The method of any of Embodiments 21 through 30, further comprising selecting the eutectic or near eutectic composition of the metal and the hard material to comprise a eutectic or near eutectic composition of cobalt and tungsten carbide.

Embodiment 32

The method of any of Embodiments 21 through 31, further comprising selecting the at least one insert to comprise a particle-matrix composite material exhibiting a wear-resistance greater than a wear resistance of the solidified molten composition.

Embodiment 33

The method any of Embodiments 21 through 32, wherein providing the at least one insert within the mold cavity comprises providing a less-than-fully sintered body within the mold cavity.

Embodiment 34

The method of any of Embodiments 21 through 33, wherein providing the at least one insert within the mold cavity comprises positioning the at least one insert at a location within the mold cavity corresponding to one of a cutting surface and a bearing surface of the at least a portion of an earth-boring tool to be formed within the mold cavity.

Embodiment 35

The method of any of Embodiments 21 through 34, further comprising pressing the roller cone after casting the molten composition within the mold cavity.

Embodiment 36

The method of any of Embodiments 21 through 35, further comprising treating at least a surface region of the roller cone to provide residual compressive stresses within the at least a surface region of the roller cone.

Embodiment 37

The method of Embodiment 36, wherein treating at least a surface region of the roller cone comprises subjecting the at least a surface region of the roller cone to a peening process.

Embodiment 38

A method of forming at least a portion of an earth-boring tool comprising coating at least one surface of a mold cavity within a mold with a coating material having a composition differing from a composition of the mold, melting a metal and a hard material to form a molten composition comprising a eutectic or near-eutectic composition of the metal and the hard material, and casting the molten composition.

Embodiment 39

The method of Embodiment 38, wherein coating at least one surface of a mold cavity with a coating material having a composition differing from a composition of the mold comprises coating at least one surface of a mold cavity within a mold comprising carbon.

Embodiment 40

The method of Embodiment 38 or Embodiment 39, wherein coating at least one surface of a mold cavity with a coating material having a composition differing from a composition of the mold comprises coating at least one surface of a mold cavity within a mold comprising graphite.

Embodiment 41

The method of Embodiment 38, wherein coating at least one surface of a mold cavity comprises coating at least one surface of a mold cavity within a mold at least substantially free of carbon.

Embodiment 42

The method of any of Embodiments 38 through 41, wherein coating at least one surface of a mold cavity comprises coating at least one surface of a mold cavity within a mold comprising at least one of a ceramic oxide and a chemically bonded phosphate ceramic material.

Embodiment 43

The method of any of Embodiments 38 through 42, wherein coating at least one surface of a mold cavity comprises coating the at least one surface of the mold cavity with a material at least substantially free of carbon.

Embodiment 44

The method of any of Embodiments 38 through 43, wherein coating at least one surface of a mold cavity comprises coating the at least one surface of the mold cavity with a ceramic oxide material.

Embodiment 45

The method of any of Embodiments 38 through 44, wherein coating at least one surface of a mold cavity comprises coating the at least one surface of the mold cavity with at least one of zirconium oxide, silicon oxide, aluminum oxide, and yttrium oxide.

Embodiment 46

The method of any of Embodiments 38 through 45, wherein coating at least one surface of a mold cavity comprises coating the at least one surface of the mold cavity with zirconium oxide.

Embodiment 47

The method of any of Embodiments 38 through 46, wherein coating at least one surface of a mold cavity comprises coating the at least one surface of the mold cavity with a coating material at least substantially comprised of zirconium oxide.

Embodiment 48

The method of any of Embodiments 38 through 47, wherein coating at least one surface of a mold cavity comprises applying at least one of a liquid suspension and a slurry to the at least one surface of the mold cavity.

Embodiment 49

The method of Embodiment 48, wherein applying at least one of a liquid suspension and a slurry to the at least one surface of the mold cavity comprises at least one of spraying and brushing the at least one of a liquid suspension and a slurry onto the at least one surface of the mold.

Embodiment 50

The method of Embodiment 48, wherein applying at least one of a liquid suspension and a slurry to the at least one surface of the mold cavity comprises filling the mold cavity with the at least one of a liquid suspension and a slurry, and substantially emptying the mold cavity of the at least one of a liquid suspension and a slurry.

Embodiment 51

The method of any of Embodiments 38 through 50, wherein coating at least one surface of a mold cavity comprises forming a multilayer coating.

Embodiment 52

The method of any of Embodiments 38 through 51, wherein coating at least one surface of a mold cavity comprises forming at least one layer of a multilayer coating having a first composition and forming at least another layer of the multilayer coating having a second composition differing from the first composition.

Embodiment 53

The method of Embodiment 52, wherein forming the at least one layer of the multilayer coating having the first composition comprises forming a barrier material between a portion of the mold and the at least another layer of the multilayer coating.

Embodiment 54

The method of Embodiment 52 or Embodiment 53, wherein forming the at least another layer of the multilayer coating comprises forming a material configured to react with the at least a portion of an earth-boring tool within the mold cavity.

Embodiment 55

The method of any of Embodiments 52 through 54, wherein forming the at least another layer of the multilayer coating comprises forming a material configured to be incorporated as an additional phase into the at least a portion of an earth-boring tool within the mold cavity.

Embodiment 56

The method of any of Embodiments 52 through 55, further comprising positioning the at least one layer of the multilayer coating between the at least one surface of the mold cavity and the at least another layer of the multilayer coating.

Embodiment 57

The method of any of Embodiments 38 through 56, wherein coating at least one surface of a mold cavity comprises coating the at least one surface of a mold cavity with a material formulated to react with the molten composition within the mold cavity.

Embodiment 58

The method of any of Embodiments 38 through 57, wherein coating at least one surface of a mold cavity comprises coating the at least one surface of a mold cavity with a material formulated to be incorporated as an additional phase into the at least a portion of an earth-boring tool within the mold cavity.

Embodiment 59

The method of any of Embodiments 38 through 58, wherein coating the at least one surface of the mold cavity with the coating material comprises depositing particles of the coating material on the at least one surface of the mold cavity and heating the particles of the coating material while they are disposed on the at least one surface of the mold cavity.

Embodiment 60

The method of Embodiment 59, wherein heating the particles of the coating material while they are disposed on the at least one surface of the mold cavity comprises at least partially sintering the particles of the coating material.

Embodiment 61

The method of any of Embodiments 38 through 60, wherein melting a metal and a hard material to form a molten composition comprising a eutectic or near-eutectic composition of the metal and the hard material comprises forming a molten composition comprising from about 40% to about 90% cobalt or cobalt-based alloy by weight and from about 0.5% to about 3.8% carbon by weight, wherein a balance of the mixture is at least substantially comprised of tungsten.

Embodiment 62

The method of any of Embodiments 38 through 61, wherein melting a metal and a hard material to form a molten composition comprising a eutectic or near-eutectic composition of the metal and the hard material comprises forming a molten composition comprising from about 55% to about 85% cobalt or cobalt-based alloy by weight and from about 0.85% to about 3.0% carbon by weight, wherein a balance of the mixture is at least substantially comprised of tungsten.

Embodiment 63

The method of any of Embodiments 38 through 62, wherein melting a metal and a hard material to form a molten composition comprising a eutectic or near-eutectic composition of the metal and the hard material comprises forming a molten composition comprising from about 65% to about 78% cobalt or cobalt-based alloy by weight and from about 1.3% to about 2.35% carbon by weight, wherein a balance of the mixture is at least substantially comprised of tungsten.

Embodiment 64

The method of any of Embodiments 38 through 63, wherein melting a metal and a hard material to form a molten composition comprising a eutectic or near-eutectic composition of the metal and the hard material comprises forming a molten composition comprising about 69% cobalt or cobalt-based alloy by weight, about 1.9% carbon by weight, and about 29.1% tungsten by weight.

Embodiment 65

The method of any of Embodiments 38 through 63, wherein melting a metal and a hard material to form a molten composition comprising a eutectic or near-eutectic composition of the metal and the hard material comprises forming a molten composition comprising about 75% cobalt or cobalt-based alloy by weight, about 1.53% carbon by weight, and about 23.47% tungsten by weight.

Embodiment 66

An article comprising at least a portion of an earth-boring tool, the article comprising at least one insert and a solidified eutectic or near-eutectic composition including a metal phase and a hard material phase.

Embodiment 67

The article of Embodiment 66, wherein the solidified eutectic or near-eutectic composition comprises an inoculant.

Embodiment 68

The article of Embodiment 66 or Embodiment 67, wherein the solidified eutectic or near-eutectic composition comprises an inoculant selected from the group consisting of a transition metal aluminate, a transition metal metasilicate, and a transition metal oxide.

Embodiment 69

The article of any of Embodiments 66 through 68, wherein the metal phase comprises at least one of cobalt, iron, nickel, and alloys thereof.

Embodiment 70

The article of any of Embodiments 66 through 69, wherein the hard material phase comprises a ceramic compound selected from the group consisting of carbides, borides, nitrides, and mixtures thereof.

Embodiment 71

The article of any of Embodiments 66 through 70, further comprising a composite microstructure that includes regions of the metal phase and the hard material phase.

Embodiment 72

The article of any of Embodiments 66 through 71, wherein the hard material phase comprises a metal carbide phase including at least one of an MC phase and an $M_2C$ phase, wherein M is at least one metal element and C is carbon.

Embodiment 73

The article of any of Embodiments 66 through 72, wherein the at least one insert comprises a particle-matrix composite material exhibiting a wear-resistance greater than a wear resistance of the solidified eutectic or near-eutectic composition.

Embodiment 74

The article of any of Embodiments 66 through 73, wherein the at least one insert comprises at least one of a cutting surface and a bearing surface of the at least a portion of an earth-boring tool.

Embodiment 75

The article of any of Embodiments 66 through 74, wherein the at least one insert is at least partially embedded in the solidified eutectic or near-eutectic composition.

Embodiment 76

The article of any of Embodiments 66 through 75, wherein the solidified eutectic or near-eutectic composition comprises from about 40% to about 90% cobalt or cobalt-based alloy by weight and from about 0.5% to about 3.8% carbon by weight, wherein a balance of the mixture is at least substantially comprised of tungsten.

Embodiment 77

The article of any of Embodiments 66 through 76, wherein the solidified eutectic or near-eutectic composition comprises from about 55% to about 85% cobalt or cobalt-based alloy by weight and from about 0.85% to about 3.0% carbon by weight, wherein a balance of the mixture is at least substantially comprised of tungsten.

Embodiment 78

The article of any of Embodiments 66 through 77, wherein the solidified eutectic or near-eutectic composition comprises from about 65% to about 78% cobalt or cobalt-based alloy by weight and from about 1.3% to about 2.35% carbon by weight, wherein a balance of the mixture is at least substantially comprised of tungsten.

Embodiment 79

The article of any of Embodiments 66 through 78, wherein the solidified eutectic or near-eutectic composition comprises about 69% cobalt or cobalt-based alloy by weight, about 1.9% carbon by weight, and about 29.1% tungsten by weight.

Embodiment 80

The article of any of Embodiments 66 through 78, wherein the solidified eutectic or near-eutectic composition comprises about 75% cobalt or cobalt-based alloy by weight, about 1.53% carbon by weight, and about 23.47% tungsten by weight.

Embodiment 81

An article comprising at least a portion of an earth-boring tool, the article comprising a solidified eutectic or near-eutectic composition including a metal phase, a hard material phase and a coating material in contact with the solidified eutectic or near-eutectic composition.

Embodiment 82

The article of Embodiment 81, wherein the solidified eutectic or near-eutectic composition comprises an inoculant.

Embodiment 83

The article of Embodiment 81 or Embodiment 82, wherein the solidified eutectic or near-eutectic composition comprises an inoculant selected from the group consisting of a transition metal aluminate, a transition metal metasilicate, and a transition metal oxide.

Embodiment 84

The article of any of Embodiments 81 through 83, wherein the metal phase comprises at least one of cobalt, iron, nickel, and alloys thereof.

Embodiment 85

The article of any of Embodiments 81 through 84, wherein the hard material phase comprises a ceramic compound selected from the group consisting of carbides, borides, nitrides, and mixtures thereof.

Embodiment 86

The article of any of Embodiments 81 through 85, further comprising a composite microstructure that includes regions of the metal phase and the hard material phase.

Embodiment 87

The article of any of Embodiments 81 through 86, wherein the hard material phase comprises a metal carbide phase including at least one of an MC phase and an $M_2C$ phase, wherein M is at least one metal element and C is carbon.

Embodiment 88

The article of any of Embodiments 81 through 87, wherein the coating material is substantially free of carbon.

Embodiment 89

The article of any of Embodiments 81 through 88, wherein the coating material comprises a ceramic oxide material.

Embodiment 90

The article of any of Embodiments 81 through 89, wherein the coating material comprises zirconium oxide, silicon oxide, aluminum oxide, or yttrium oxide.

Embodiment 91

The article of any of Embodiments 81 through 90, wherein the coating material comprises a multilayer coating.

Embodiment 92

The article of Embodiment 91, wherein the multilayer coating comprises at least one layer having a first composition and at least another layer having a second composition differing from the first composition.

Embodiment 93

The article of any of Embodiments 81 through 92, wherein the at least one insert is at least partially embedded in the solidified eutectic or near-eutectic composition.

Embodiment 94

The article of any of Embodiments 81 through 93, wherein the solidified eutectic or near-eutectic composition comprises from about 40% to about 90% cobalt or cobalt-based alloy by weight and from about 0.5% to about 3.8% carbon by weight, wherein a balance of the mixture is at least substantially comprised of tungsten.

Embodiment 95

The article of any of Embodiments 81 through 94, wherein the solidified eutectic or near-eutectic composition comprises from about 55% to about 85% cobalt or cobalt-based alloy by weight and from about 0.85% to about 3.0% carbon by weight, wherein a balance of the mixture is at least substantially comprised of tungsten.

Embodiment 96

The article of any of Embodiments 81 through 95, wherein the solidified eutectic or near-eutectic composition comprises from about 65% to about 78% cobalt or cobalt-based alloy by weight and from about 1.3% to about 2.35% carbon by weight, wherein a balance of the mixture is at least substantially comprised of tungsten.

Embodiment 97

The article of any of Embodiments 81 through 96, wherein the solidified eutectic or near-eutectic composition comprises about 69% cobalt or cobalt-based alloy by weight, about 1.9% carbon by weight, and about 29.1% tungsten by weight.

Embodiment 98

The article of any of Embodiments 81 through 96, wherein the solidified eutectic or near-eutectic composition comprises about 75% cobalt or cobalt-based alloy by weight, about 1.53% carbon by weight, and about 23.47% tungsten by weight.

Although the foregoing description contains many specifics, these are not to be construed as limiting the scope of the present invention, but merely as providing certain exemplary embodiments. Similarly, other embodiments of the invention may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A method of forming at least a portion of an earth-boring tool, comprising:

providing at least one insert in a mold cavity;

providing particulate matter comprising a hard material in the mold cavity;

melting a metal and the hard material to form a molten composition comprising a eutectic or near-eutectic composition of the metal and the hard material;

casting the molten composition within the mold cavity; and providing an inoculant within the mold cavity to control grain growth as the molten composition comprising the eutectic or near eutectic composition of the metal and the hard material solidifies within the mold cavity.

2. The method of claim 1, further comprising adjusting a stoichiometry of at least one hard material phase of the at least a portion of the earth-boring tool.

3. The method of claim 1, wherein melting a metal and a hard material to form a molten composition comprises forming a eutectic or near-eutectic composition of cobalt and tungsten carbide.

4. The method of claim 1, wherein melting a metal and a hard material to form a molten composition comprises melting a mixture comprising from about 40% to about 90% cobalt or cobalt-based alloy by weight and from about 0.5% to about 3.8% carbon by weight, wherein a balance of the mixture is at least substantially comprised of tungsten.

5. The method of claim 1, wherein melting a metal and a hard material to form a molten composition comprises melting a mixture comprising about 69% cobalt or cobalt-based alloy by weight, about 1.9% carbon by weight, and about 29.1% tungsten by weight.

6. The method of claim 1, wherein melting a metal and a hard material to form a molten composition comprises melting a mixture comprising about 75% cobalt or cobalt-based alloy by weight, about 1.53% carbon by weight, and about 23.47% tungsten by weight.

7. The method of claim 1, wherein providing the at least one insert in the mold cavity comprises providing a less-than-fully sintered body.

8. A method of forming a roller cone of an earth-boring rotary drill bit, comprising:

providing at least one insert within a mold cavity;

forming a molten composition comprising a eutectic or near-eutectic composition of cobalt and tungsten carbide;

casting the molten composition within the mold cavity adjacent at least a portion of the at least one insert;

solidifying the molten composition within the mold cavity; and using an inoculant to control grain growth as the molten composition solidifies within the mold cavity.

9. The method of claim 8, wherein forming a molten composition comprises forming a molten composition comprising about 69% cobalt or cobalt-based alloy by weight, about 1.9% carbon by weight, and about 29.1% tungsten by weight.

10. The method of claim 8, further comprising selecting the inoculant from the group consisting of a transition metal aluminate, a transition metal metasilicate, and a transition metal oxide.

11. The method of claim 8, further comprising selecting the at least one insert to comprise a particle-matrix composite material exhibiting a wear-resistance greater than a wear resistance of the solidified molten composition.

12. The method of claim 8, wherein providing the at least one insert within the mold cavity comprises providing a less-than-fully sintered body within the mold cavity.

* * * * *

UNITED STATES PATENT AND TRADEMARK OFFICE

CERTIFICATE OF CORRECTION

PATENT NO. : 8,905,117 B2
APPLICATION NO. : 13/111783
DATED : December 9, 2014
INVENTOR(S) : John H. Stevens et al.

It is certified that error appears in the above-identified patent and that said Letters Patent is hereby corrected as shown below:

On the title page:

In ITEM (73) Assignee: change "Incoporated," to --Incorporated,--

Signed and Sealed this
Thirtieth Day of June, 2015

Michelle K. Lee

Michelle K. Lee
*Director of the United States Patent and Trademark Office*